United States Patent [19]

Yanagawa

[11] 4,183,652

[45] Jan. 15, 1980

[54] PHOTOCONDUCTOR SHEET CLAMP APPARATUS

[75] Inventor: Nobuyuki Yanagawa, Chigasaki, Japan

[73] Assignee: Ricoh Company, Ltd., Japan

[21] Appl. No.: 899,856

[22] Filed: Apr. 25, 1978

[30] Foreign Application Priority Data

Apr. 30, 1977 [JP] Japan ..... 52-50260
May 23, 1977 [JP] Japan ..... 52-59633

[51] Int. Cl.[2] ..... G03G 15/00; B41F 21/04

[52] U.S. Cl. ..... 355/3 DR; 101/415.1; 355/16

[58] Field of Search ..... 355/3 R, 3 BE, 3 DR, 355/16; 101/415.1

[56] References Cited

U.S. PATENT DOCUMENTS

| | | | |
|---|---|---|---|
| 2,294,933 | 9/1942 | Pursell | 101/415.1 X |
| 3,839,961 | 10/1974 | Murata | 101/415.1 X |
| 3,858,513 | 1/1975 | Murata | 101/415.1 |
| 3,903,795 | 9/1975 | Suzuki | 101/415.1 X |

*Primary Examiner*—Fred L. Braun
*Attorney, Agent, or Firm*—McGlew and Tuttle

[57] ABSTRACT

The apparatus comprises a drum around which a photoconductor sheet is to be wound, a front end clamp member and a back end clamp member disposed in a recess formed along a generating line of the peripheral surface of the drum, a front end clamp member operation device, a back end clamp operation device, separation guides for separating the leading end portion of the photoconductor sheet from the drum, and a drum stopping device for stopping the drum at a predetermined position for exchanging the photoconductor sheet. The front end clamp member is disposed in the recess, and the back end clamp member is rotatable around the drum independently of the drum during the photoconductor sheet exchanging process. The front end clamp member operation device is operable to move the front end clamp member radially, and the back end clamp member operation device is operable to stop the back end clamp member so as to rotate the back end clamp relative to the drum.

17 Claims, 42 Drawing Figures

1
10
22
25
137
Y
P1
P2
S1
S2
le
le1
α
δ
S
Sb
16
26
39
θ
A
B
4
51
1a

PHOTOCONDUCTOR SHEET CLAMP APPARATUS

BACKGROUND OF THE INVENTION

The present invention relates to a sheet clamp apparatus, more particularly to a photoconductor sheet clamp apparatus capable of clamping a photoconductor sheet to a drum for use with an electrophotographic copying apparatus and unclamping the photoconductor sheet therefrom securely and easily.

In the electrophotographic copying apparatus, a selenium photoconductor and a zinc oxide photoconductor are used as representative light sensitive materials. The former is excellent in photoconductivity and dielectric characteristics and can be used repeatedly in the electrostatic image formation process. It is, however, expensive. On the other hand, the zinc oxide photoconductor is cheaper than the selenium photoconductor, but its life time for use in the electrostatic image formation is not as long as that of the selenium photoconductor. However, recently the zinc oxide photoconductor has been improved so that its life time is lengthened. Therefore, the zinc oxide photoconductor has an advantage of being lower in cost.

Accordingly, when the zinc oxide photoconductor is used in the electrophotographic copying apparatus in the form of a sheet to be wound around a drum, it has to be exchanged more frequently with a fresh zinc oxide photoconductor in comparison with the selenium photoconductor, still due to the life time of the zinc oxide photoconductor.

Supposing that the life time of the zinc oxide photoconductor sheet is approximately 500 copies in terms of the number of copies that can be made acceptably by the photoconductor, obviously it has to be exchanged frequently in practical use.

SUMMARY OF THE INVENTION

For the foregoing reason, a principal object of the present invention is to provide a photoconductor sheet clamp apparatus which permits easy and speedy exchange of a photoconductor sheet and clamping thereof to a drum.

It is another object of the invention to provide a drive transmission apparatus for rotating clamp means around the drum smoothly in order to clamp the photoconductor sheet to or unclamp the same from the drum.

It is a further object of the present invention to provide a drum stopping apparatus for stopping the drum at a predetermined position other than its normal copy stand-by position in order to exchange the photoconductor sheet with a fresh photoconductor sheet.

In the present invention, a front end clamp member for clamping the leading end of a photoconductor sheet is disposed on one inclined wall of a recess formed along a generating line of the peripheral surface of a drum around which the photoconductor sheet is to be wound.

The front end clamp member is movable outwardly of the drum when the photoconductor sheet is unclamped, but while copying is being made or while the drum is being rotated to a predetermined unclamping position, it clamps tightly the leading end portion of the photoconductor sheet.

Furthermore, a back end clamp member for clamping the trailing end portion of the photoconductor is provided. When the photoconductor sheet is clamped, the back end clamp member is in pressure contact with the other inclined wall of the recess and is rotated integrally with the drum end and when the photoconductor sheet is unclamped for exchanging the photoconductor sheet, it is rotated independently of the drum so that it climbs the inclined wall and moves around the peripheral surface.

When the back end clamp member is rotated independently of the drum, one end portion or both end portions of the back end clamp member are stopped by stop means in one embodiment of the invention. However, in another embodiment of the invention, by use of epicyclic gear trains, a smooth rotation of the back end clamp member along the peripheral surface of the drum is attained.

In a further embodiment of the invention, a drum stopping apparatus, comprising a gear which is substantially integral with the drum, a driving gear capable of rotating the gear attached to the drum, and a spring clutch disposed between the driving gear and the shaft of the driving gear, is provided, which is capable of stopping the drum at a predetermined position other than its normal copy standby-position for exchanging the photoconductor.

In order to separate the photoconductor sheet from the peripheral surface of the drum, a leading end separation guide means is provided, which is operable to advance along the bottom of the recess to enter beneath the leading end portion of the photoconductor.

BRIEF DESCRIPTION OF THE DRAWINGS

For a better understanding of the invention as well as the objects and other features, reference will be had to the following detailed description which is to be read in conjunction with the drawings wherein:

FIG. 41 (B) is a perspective illustration of the photoconductor sheet loading package of FIG. 41 (A) after it is opened.

Throughout the above figures, the identical or substantially identical parts or members are given identical numerals.

DETAILED DESCRIPTION OF THE PREFERRED EMBODIMENTS

Figure 1:
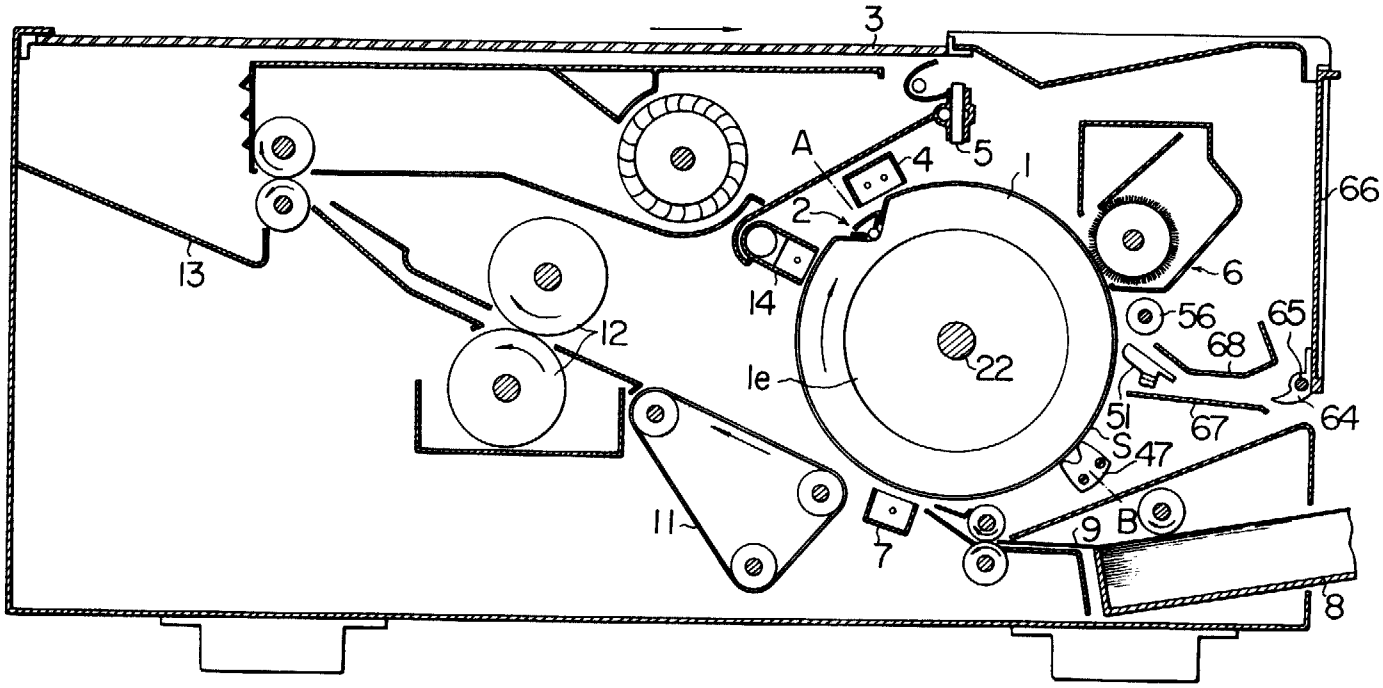
FIG. 1 is a schematic sectional side elevation of an electrostatic copying machine in which an embodiment of the invention can be employed.

Referring to FIG. 1, there is shown an electrophotographic copying machine in which an embodiment of the present invention is employed. In the figure, a photoconductor sheet S (hereinafter referred to as photoconductor S), which is cut to a predetermined length, is wound around a drum 1, and the leading and trailing ends of the photoconductor S are clamped at clamp means 2 disposed at a peripheral portion of the drum 1. After each copying process, the clamp means 2 is normally positioned at a stop position A which will be described in detail later. When the clamp means 2 is in this position, an original to be copied is placed on a contact glass 3. When a print button (not shown) is pressed, the drum 1 is rotated in the direction of the arrow.

The surface of the photoconductor S is uniformly charged by a charger 4, and a latent electrostatic image corresponding to an image of the original placed on the contact glass 3 is formed on the photoconductor S by a SELFOC lens 5 (registered trademark, an array of image transmitting optical fibers). At this moment, the contact glass 3 is moved forward, that is, in the direction of the arrow in FIG. 1. The latent electrostatic image formed on the photoconductor S is then developed by a development apparatus 6. By an image transfer charger 7, the thus developed image is transferred to a transfer sheet 9 fed from a sheet feed tray 8. The image bearing transfer sheet 9 is transported by a transport belt 11 so that it is caused to pass between a pair of image fixing rollers 12 where the image is fixed on the transfer sheet 9. The transfer sheet 9 is then discharged onto a sheet discharge tray 13. In the meantime, the residual charges on the photoconductor S are nullified by a quenching charger 14. The drum 1 is further rotated, and when it has been rotated exactly two times, the clamp means 2 is stopped at the position A. After the exposure by the SELFOC 5, the contact glass 3 is moved backwards, that is, in the direction opposite to the arrow in FIG. 1, so that the contact glass 3 is returned to its original position.

The above is the copying process of the electrophotographic copying machine employed in the present invention.

The specific construction of the photoconductor sheet attachment and detachment apparatus will be described below by referring to FIG. 2. As aforementioned, the photoconductor S is wound around the peripheral surface of the drum 1, and the leading end Sa of the photoconductor S is clamped by a front clamp member while the trailing end Sb of the photoconductor S is clamped by a back clamp member as will be described in detail later.

Figure 3:
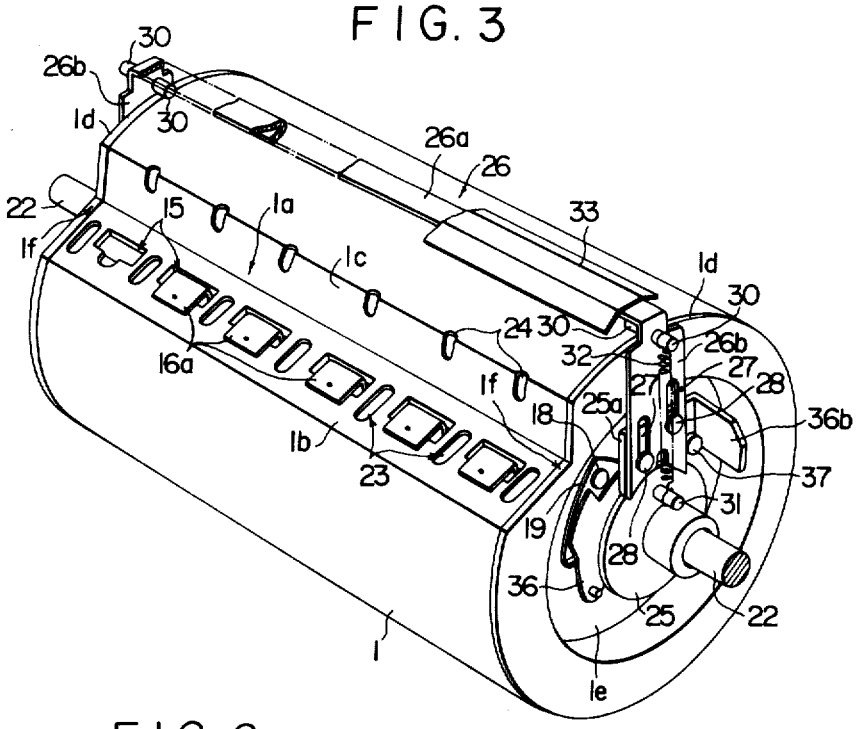
FIG. 3 is a perspective illustration of a drum for use with the photoconductive sheet clamp apparatus of FIG. 2.
Figure 4:
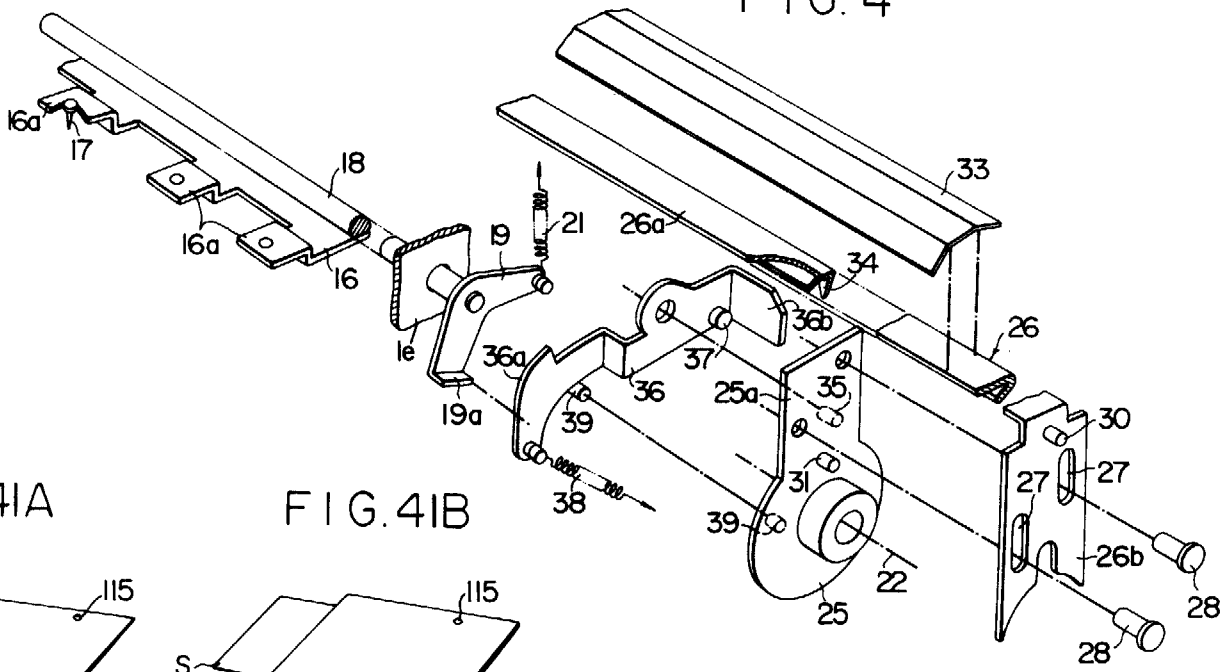
FIG. 4 is a perspective fragmentary illustration of a front end clamp member and a back end clamp member for use with the drum of FIG. 3, which particularly shows the clamping and unclamping mechanism of the two clamp members.

At one peripheral portion of the drum 1, there is formed a V-shaped recess 1a along a generating line of the drum 1 as shown in FIG. 3. Normally, the V-shaped recess la is positioned at the position A. In an inclined wall 1*b* of the recess 1*a*, there are formed a plurality of notches 23 and a plurality of windows 15. A plurality of fingers 16*a*, which are extended from a free end of a front clamp member 16 as shown in FIG. 4, are projected from the windows 15. A clamp nail 17 is secured to each finger 16*a* as shown in FIG. 4.

Figure 8:
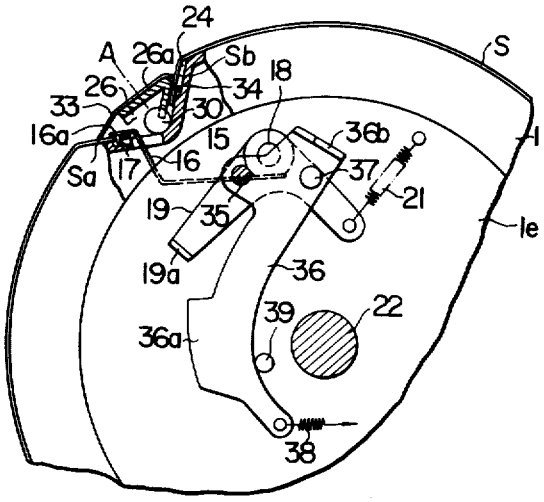
FIG. 8 is a partial schematic side elevation of the drum of FIG. 3, in which the drum is in its original position and the leading end portion of the photoconductor sheet is clamped to the drum.

Referring to FIG. 4, a base of the front clamp member 16 is fixed to a shaft 18 which is disposed inside the drum 1 and which is rotatably supported on both inner end walls 1*e* of the drum 1. To one end portion of the shaft 18, there is fixed a follower lever 19 which is disposed adjacent to the outside of one of the inner end walls 1*e*. At one end of the follower lever 19, there is formed a bent end 19*a*. As shown in FIGS. 4 and 8, the follower lever 19 is given a counterclockwise bias about the shaft 18 by a spring 21. However, the rotation of the follower lever 19 by the counterclockwise bias is hindered by the respective fingers 16*a* brought into contact with the inclined wall 1*b*.

Referring to FIGS. 3 and 4, a drum shaft 22, which is substantially integral with the drum 1, is rotatably supported by both side plates (not shown), and a pair of keyhole shaped support arm plates 25 are fitted on opposite end portions of the drum shaft 22.

A back end clamp member 26 has a support member 26*a* which is bent along a generating line of the drum 1 and a pair of sliding plates 26*b*, which are bent from both ends of the support member 26*a* so as to bridge both sides of the drum 1. The back end clamp member 26 is designed so as to be slidable in the radial direction of the drum 1 by guide slots 27 formed in the sliding plates 26*b* and pivots 28 secured to the support arm plate 25.

Figure 5:
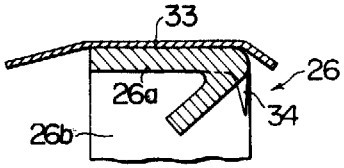
FIG. 5 is a sectional view of the main portion of the back end clamp member of FIG. 4.

A spring 32 is connected between a pin 30 fixed to each sliding plate 26*b* and a pin 31 fixed to each support arm plate 25. The back end clamp member 26 is normally positioned at the position A as shown in FIG. 2. Each pin 30 which passes through a respective sliding plate 26*b* in the axial direction of the drum 1 is in pressure contact with the bottom of the adjacent end of the V-shaped recess 1*a*. As shown in FIG. 5, on the support member 26*a* of the back end clamp member 26, there is fixedly mounted a thin metallic pressure plate 33, and on one longitudinal side of the support member 26*a*, there are formed a plurality of clamp nails 34 which extend downwards, with an appropriate space therebetween. The respective tips of the clamp nails 34 are fitted into notches 24 formed on the other inclined wall 1*c* of the V-shaped recess 1*a* (refer to FIG. 8).

On a pivot 35 which is fixed to the support arm plate 25, there is pivotally mounted an opening-and-closing control member 36 which opens or closes the front end clamp member 16 (refer to FIG. 4). In the opening-and-closing control member 36, there is formed a cam portion 36*a* with which a bent end 19*a* of the follower lever 19 is to be engaged. Furthermore, a pin 37 for stopping the back end clamp member 26 is fixedly mounted on the control member 36. The control member 36 is given a counterclockwise bias about the shaft 35 by a spring 38 in FIG. 2. However, the rotation of the member 36 is hindered by a pin 39 fixed to the support arm plate 25.

Figure 2:
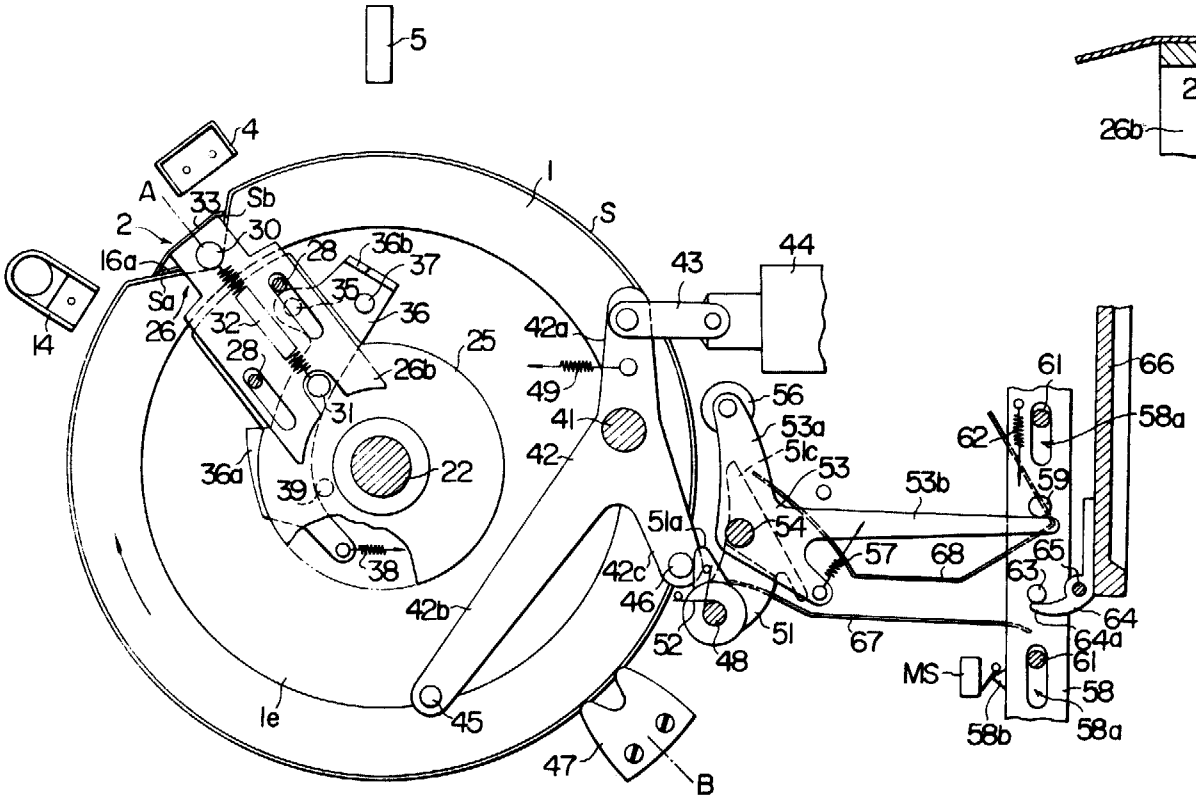
FIG. 2 is a schematic elevation of one embodiment of the photoconductive sheet clamp apparatus according to the invention, which particularly shows its original configuration.

In FIG. 2, closely adjacent one end of the drum 1, there is arranged a limiting lever 42 which is pivotally mounted on a shaft 41 fixed to a machine frame side plate (not shown). One arm 42*a* of the limiting member 42 is connected to a solenoid 44 through a connecting rod 43. To the other arm 42*b* and a sub-arm 42*c* of the limiting lever 42, there are fixed pins 45, 46, respectively. The reference numeral 47 represents a stopper which is kept stationary for stopping the back end clamp member 26.

On the right side of the drum 1 and closely adjacent the peripheral surface of the drum 1 in FIG. 2, scraper means 51 is disposed, which includes a rotatable shaft pivotally mounted on a shaft 48 fixed to a frame side plate (not shown). One end portion of the scraper means 51 is provided with an operation arm 51*a* (refer to FIGS. 2 and 7). The operation arm 51*a* is maintained in pressure contact with a pin 46 of the limiting lever 42 by a spring 52. To a supporting rod portion 51*b* of the scraper means 51, there are fixed a plurality of separation fingers 51*c* which face the peripheral surface of the drum 1 (see FIG. 7). In FIG. 2, on the right side of the drum 1 and, in FIG. 6, on the opposite end of the drum 1, a pair of supporting levers 53 (one of them is not shown) are arranged.

The supporting levers 53 are pivotally mounted on a shaft 54 fixed to frame side plates (not shown), and a discharge roller 56 is rotatably mounted between the end portions of the arms 53*a* of the supporting levers 53. At least one supporting lever has another arm 53*b* whose end portion is maintained in pressure contact with a pin 59, fixed to a sliding plate 58 by a spring 57.

The sliding plate 58 is designed so as to be slidable upwards and downwards, guided by fixed pins 61 fitted in guide slots 58*a*, and it is urged so as to slide downwards by a spring 62. However, the position of the sliding plate 58 is maintained by a pin 63 fixed to the sliding plate 58 and engaged with a hook 64*a* of a hinge 64 as shown in FIG. 2. The hinge 64 is pivotally mounted on a shaft 65 fixed to a base plate (not shown) of the present copying machine. The hinge 64 serves to fix a base of a door 66 to a side portion of the present copying machine as shown in FIG. 1.

The reference numerals 67, 68 represent guide plates for guiding the photoconductor S when it is supplied or discharged. FIG. 1 illustrates a state of the copying machine when one cycle of copying process is over, where the clamp means 2 on the drum 1 is stopped at a normal stop position where the copying machine is ready for the next copying, namely at the position A a little behind the charger 4. At this moment, the back end clamp member 26 is positioned at a position as shown in FIG. 2, and both pins 30 are maintained in pressure contact with both ends 1*f* (refer to FIG. 3) of the V-shaped recess 1*a* by the resilience of the spring 32.

Furthermore, as shown in FIG. 8, the clamp nails 17 of the front end clamp member 16 pierce the leading end portion Sa of the photoconductor S, whereby the leading end portion Sa is clamped. The trailing end portion Sb of the photoconductor S is clamped by the clamp nails 34 of the back end clamp member 26, which pierce the trailing end portion of the photoconductor S. The thin metalic pressure plate 33 serves to strengthen the clamping action of the clamp means 2 since both ends of the photoconductor are pressed elastically against the V-shaped recess 1*a* by opposite sides of the pressure plate 33. In FIG. 1, both the scraper means 51 and the discharge roller 56 are retracted from the peripheral surface of the drum 1, and the door 66 is closed.

Figure 9:
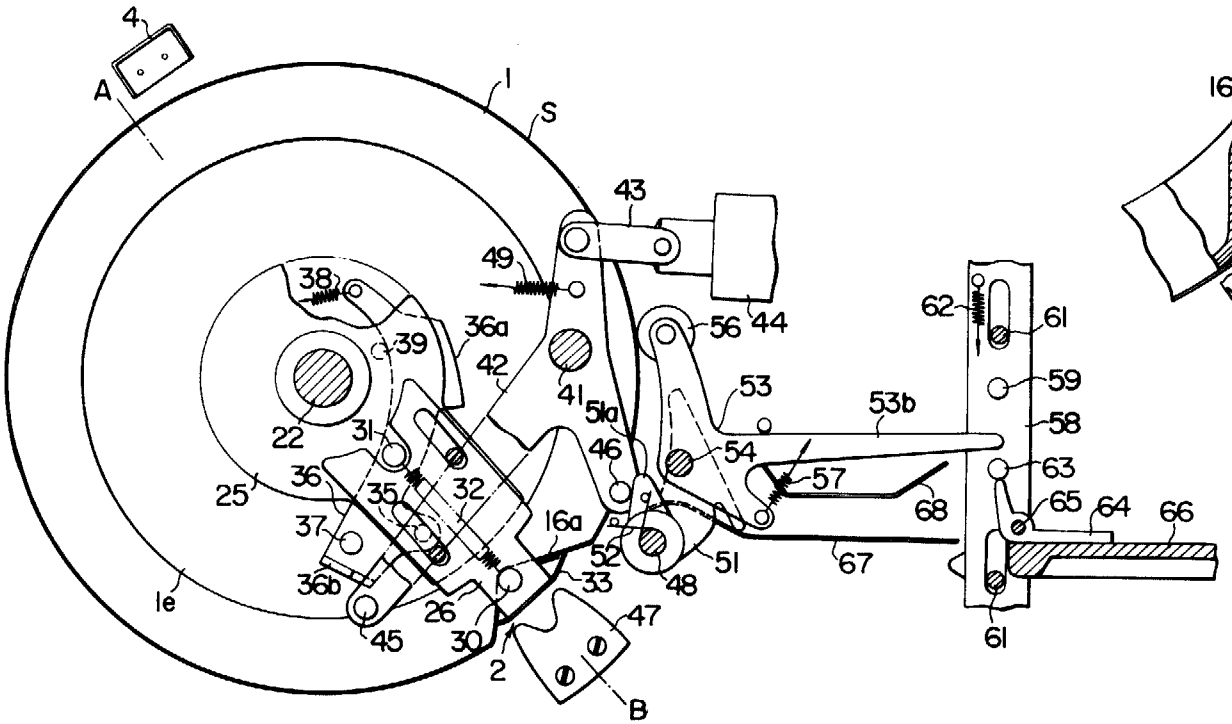
FIG. 9 is a schematic elevation of the photoconductor sheet clamp apparatus of FIG. 2, in which the drum is stopped at a position for exchanging the photoconductor sheet.

In this condition, when a predetermined number of copies, for instance, 500 copies, have been made by use of the same photoconductor S wound around the drum 1, the present copying machine is designed so that a command to replace the photoconductor S with a fresh photoconductor is given by a signal from a counter (not shown), and by lighting of a lamp for commanding the change of the photoconductor, for instance, of a lamp disposed on an operation panel, in accordance with the command. In accordance with the lighting of the lamp, when the door 66 is turned about the shaft 65 from the vertical position as shown in FIG. 2 to the horizontal position as shown in FIG. 9, the tip of the hinge 64 pushes the pin 63 upwards so that the sliding plate 58 is caused to slide upwards against the resilience of the spring 62. Thus, when the door 66 is opened to the horizontal position, it is locked by a locking member (not shown).

The supporting lever 53, whose arm 53*a* has been in pressure contact with the pin 59 in accordance with the abovementioned sliding action of the sliding plate 58, is turned counterclockwise about the shaft 54 by the resilience of the spring 57, so that the discharge roller 56 is brought into pressure contact with the drum 1 through the photoconductor S wound around the drum 1. While the sliding plate 58 is caused to slide upwards, a microswitch MS is turned on by a projected member 58*b* disposed at one side of the sliding plate 58 in FIG. 2. By a commanding signal produced with the microswitch MS on, a driving mechanism (not shown) for rotating the drum 1 is actuated so that the drum 1 and the drum shaft 22, which are substantially integral, are rotated in the direction of the arrow from the position shown in FIG. 2 at the same speed as when copied, and are then stopped at the position shown in FIG. 9. To be more specific, the drum 1 is stopped at the position B where the clamp means 2 on the drum 1 faces the stopper 47 for exchanging the photoconductor S with a fresh one.

The drum 1 is stopped at the position B by a drive transmission to the drum 1 disconnected from a driving mechanism for driving the drum 1 by an appropriate clutch mechanism.

Figure 10:
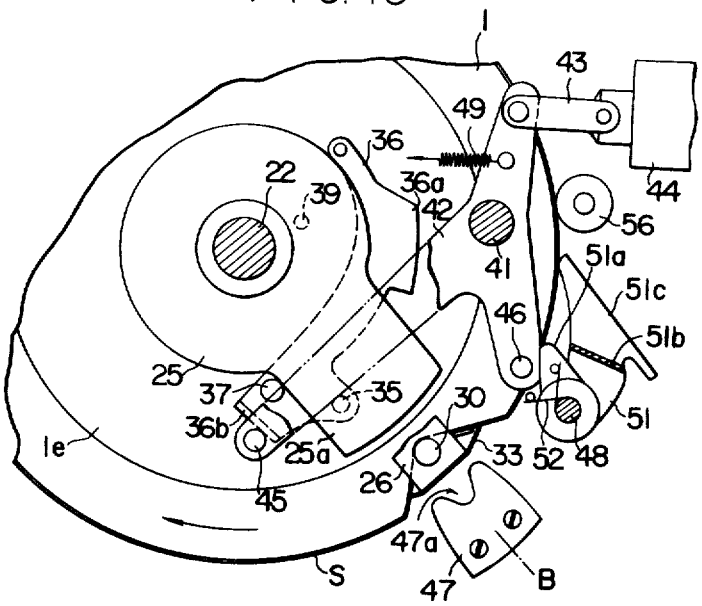
FIG. 10 is a partial schematic elevation of the photoconductor sheet clamp apparatus of FIG. 2, in which a solenoid is energized so as to stop the back end clamp member at the above-mentioned position for exchanging the photoconductor sheet.
Figure 11:
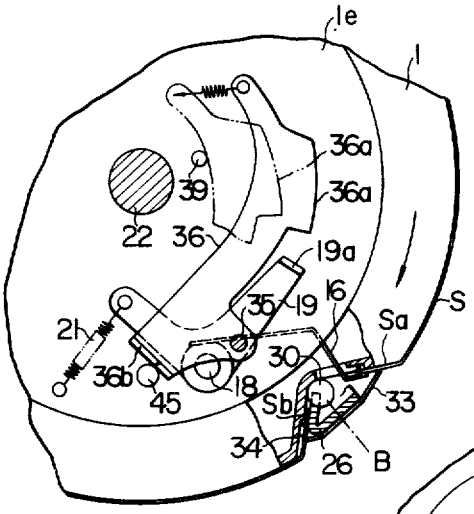
FIG. 11 is a partial schematic side elevation of the drum, which shows the clamping state of the leading end portion of the photoconductor sheet when the clamping members are positioned at their stop position for exchanging the photoconductor sheet.

When the clamp means 2 is stopped at the position B, the solenoid 44 is energized so that the limiting lever 42 is turned clockwise about the shaft 41 against the resilience of a spring 49. As a result, the pin 45 of the limiting lever 42 is moved from the position shown in FIG. 9 to the position shown in FIG. 10, and bent end 36*b* of the opening-and-closing control member 36 is pushed by the pin 45, so that the control member is turned clockwise about the shaft 35 against the resilience of the spring 38. The opening-and-closing control member 36 becomes disengaged from the pin 39, and the cam portion 36*a* reaches the rotation path of the bent end 19*a* of the follower lever 19 as shown in FIG. 11. Furthermore, in accordance with the above-mentioned rotation of the control member 36, the pin 37 is moved from the position of FIG. 9 to that of FIG. 10 so that it is brought into pressure contact with a side of an extended portion 25*a* of the support lever plate 25.

Meanwhile, by the clockwise rotating action of the limiting member 42, the pin 46 of the limiting lever 42, which has been in pressure contact with the operation arm 51*a* of the scraper means 51 in FIG. 9, is disengaged from the operation arm 51*a*. Thus, the scraper means 51 is rotated counterclockwise about the shaft 48 by the resilience of the spring 52, so that separating fingers 51*c* (refer to FIG. 7) are brought into pressure contact with the peripheral surface of the drum 1 through the photoconductor S as shown in FIG. 10. From the position shown in FIGS. 10 and 11, the drum 1 is rotated again in the direction of the arrow, and the follower lever 19 is rotated integrally with the drum 1. In the meantime, the support arm plate 25 fitted on the shaft 22 and the opening-and-closing control member 36 pivotally mounted on the support arm plate 25 through the shaft 35 remain stationary irrespective of the rotation of the drum 1 since they are stopped by the pin 37 and the pin 45, respectively.

Figure 12:
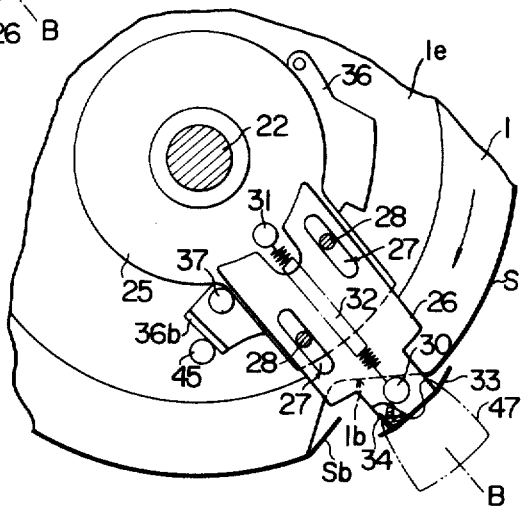
FIG. 12 is a partial schematic side elevation of the drum which has been rotated from the position shown in FIG. 11.

On the other hand, as the drum 1 is rotated, the pins 30 (refer to FIG. 3) of the back end clamp members 26 climb the end portions of the inclined wall 1*b* of the V-shaped recess 1*a* against the resilience of the springs 32, and, at the same time, the back end clamp member 26 is slidingly guided by the pivots 28 in the radial direction of the drum 1 and also in the direction of the stopper 47. Namely, the back end clamp member 26 is moved from the position shown in FIG. 9 to the position shown in FIG. 12. In the meantime, the clamp nails 34 which have pierced the trailing end portion Sb of the photoconductor S are released from the trailing end portion Sb as shown in FIG. 12, so that trailing end portion Sb is unclamped.

Figure 13:
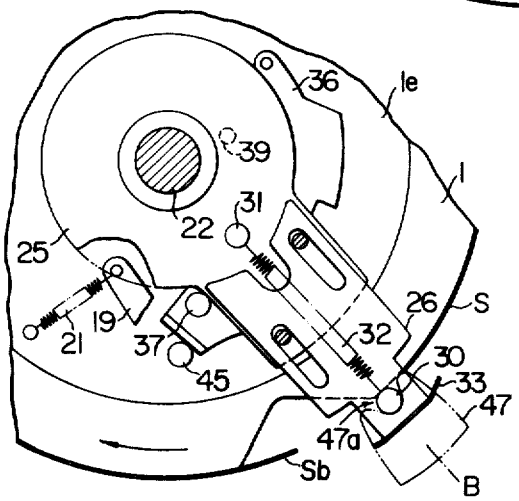
FIG. 13 is a partial schematic side elevation of the drum, in which a pin of the back end clamp member has climbed a peripheral track of the drum.
Figure 14:
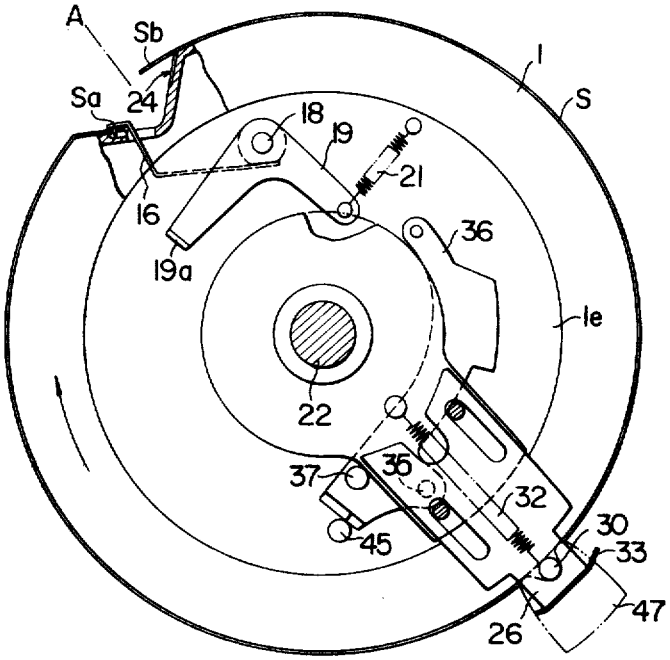
FIG. 14 is a schematic side elevation of the drum which has been rotated further from the position shown in FIG. 13.

When the pins 30 climb peripheral tracks 1*d* on the opposite sides of the drum 1 (refer to FIG. 3) with a further rotation of the drum 1 as shown in FIG. 13, the pins 30 are engaged with a concave portion 47*a* of the stopper 47, whereby the support arm plates 25, the opening-and-closing control member 36, and the back end clamp member 26 are stopped. On the other hand, the drum 1 is continuously rotated, together with the follower lever 19, in the direction of the arrow as shown in FIG. 14. At this moment, the leading end Sa of the photoconductor S is still clamped by the front end clamp member 16.

Figure 15:
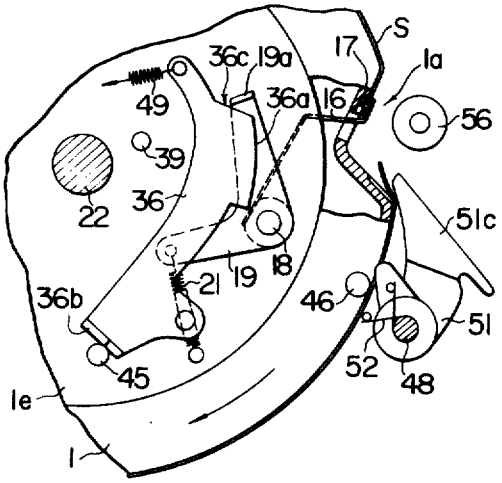
FIG. 15 is a partial schematic elevation of the photoconductor sheet clamp apparatus just before the front end clamp member is opened.
Figure 16:
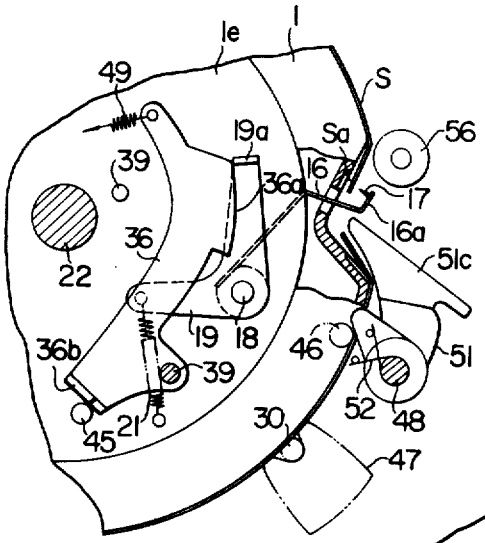
FIG. 16 is a partial schematic elevation of the photoconductor sheet clamp apparatus when the front end clamp member is opened.
Figure 17:
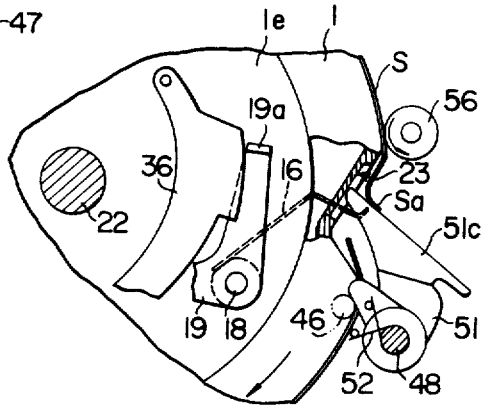
FIG. 17 is a partial schematic elevation of the photoconductor sheet clamp apparatus when the leading end portion of the photoconductor sheet is separated from the peripheral surface of the drum by the scraper means of FIG. 7.

When the drum 1 is further rotated from the positon shown in FIG. 13 to the position shown in FIG. 14 and reaches the position shown in FIG. 15, an inner side of the bent end 19*a* of the follower lever 19 that has been rotated integrally with the drum 1 comes into contact with an inclined side edge 36*c* of the cam portion 36*a* of the opening-and-closing control member 36 which is stopped. By a further rotation of the drum 1, the bent end 19*a* climbs a cam edge of the cam portion 36*a* as shown in FIG. 16, and, at the same time, the follower lever 19 is rotated clockwise about the shaft 18 against the resilience of the spring 21 from the position shown in FIG. 15 to the position shown in FIG. 16, whereby the front end clamp member 16, whose base is fixed to the shaft 18, is also rotated clockwise. At this moment, the clamp nails 17 which have pierced the leading end portion Sa of the photoconductor S are pulled out from the leading end portion Sa so that the leading end portion Sa of the photoconductor S is unclamped as shown in FIG. 16.

Front end clamp member operation means are thus provided in the form of control member 36, which is activated by limiting member 42 to move follower lever 19 which is connected to the front end clamping member 16 with the other associated elements for clamping and unclamping the leading end portion of the photoconductor sheet. Back end clamp member operation means are also thus provided which are shown in the form of support arm plate 25, sliding plate 26*b* with its pin 30 which rides up in portion 1*f* of the drum 1 for moving the back end clamp member 26 with respect to the drum 1 to release the trailing end portion of the photoconductor sheet.

In the meantime, as a plurality of the separation fingers 51*c* of the scraper means 51, which have been maintained in pressure contact with the peripheral surface of the drum 1 by the resilience of the springs 52, draw near the V-shaped recess 1*a*, the respective tips of the separation fingers 51*c* gradually enter the groove 1*a* as shown in FIG. 15 and finally come into contact with the bottom of each notch 23 (refer to FIG. 3). In the meantime, the leading end portion Sa of the photoconductor S is guided over the separation fingers 51*c* so that the leading end portion Sa is completely separated from the front end clamp member 16.

Figure 18:
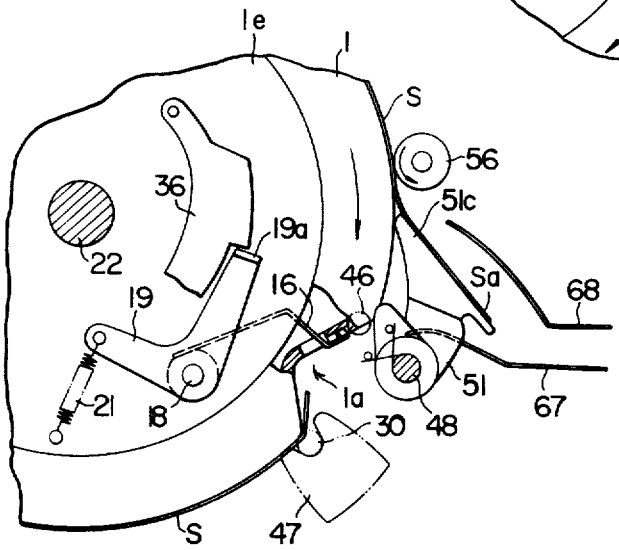
FIG. 18 is a partial schematic elevation of the photoconductor sheet clamp apparatus when the photocondutor sheet is guided over the separation fingers of the scraper means of FIG. 7.

With a further rotation of the drum 1, the respective bottoms of the notches 23 push the separation fingers 51*c* and rotate the scraper means 51 clockwise about the shaft 48 against the resilience of the springs 52. The separation fingers 51*c* are again brought into pressure contact with the peripheral surface of the drum 1 as shown in FIG. 18. In the meantime, the discharge roller 56, which presses the photoconductor S against the peripheral surface of the drum 1 by the resilience of the springs 57, is rotated together with the drum 1 in the direction of the arrow in FIG. 18, and by the rotation of the discharge roller 56 and by the guiding action of the separation fingers 51*c*, the leading end portion Sa of the photoconductor S is led in the direction of a guide plate 67.

Figure 19:
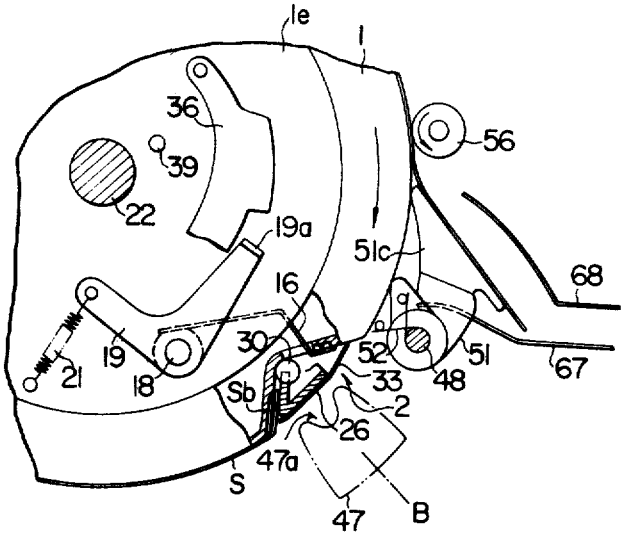
FIG. 19 is a partial schematic elevation of the photoconductor sheet clamp apparatus when the pins of the back end clamp members are dropped into the recess of the drum after one revolution of the drum from the position shown in FIG. 9.

When the drum 1 is rotated further from the position shown in FIG. 18 to the position shown in FIG. 19, namely when the clamp means 2 of the drum 1 exactly reaches the position B by one rotation of the drum 1 from the position shown in FIG. 9, the pins 30 of the back end clamp member 26 are again engaged into the ends of the bottom of the V-shaped recess 1*a* by the resilience of the springs 32. As a result, the trailing end portion Sb of the photoconductor S is again clamped by the back end clamp member 26. However, since the drum 1 is further rotated, the pins 30 again climb the peripheral tracks 1*d* at both ends of the drum 1 so that the trailing end portion Sb of the photoconductor S is again unclamped as shown in FIG. 20.

Figure 20:
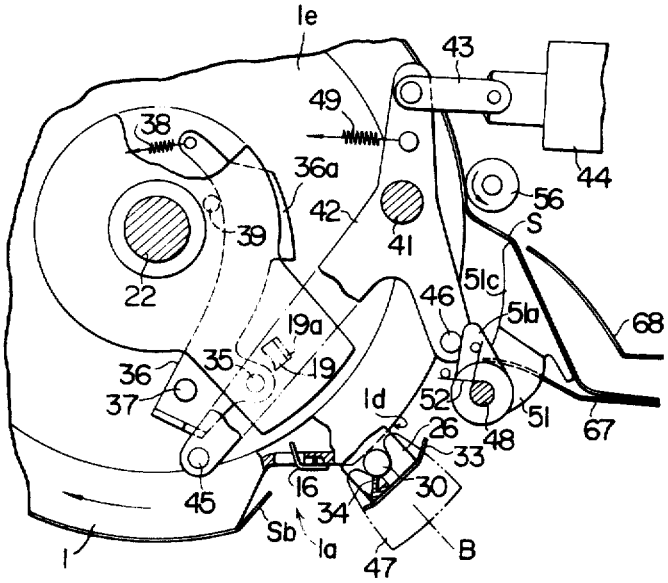
FIG. 20 is a partial schematic elevation of the photoconductor sheet clamp apparatus when the above-mentioned pins climb the peripheral track of the drum after the drum is rotated a little further from the position shown in FIG. 19.

In FIG. 20, after the pins 30 climb the peripheral tracks 1*d* and are then engaged with the concave portion 47*a* of the stopper 47, the solenoid 44 is deenergized, whereby the limiting lever 42 is rotated counterclockwise from the position shown in FIG. 10 to the original position shown in FIG. 20 by the resilience of the spring 49. Consequently, the pin 45 of the limiting lever 42 is moved from the position shown in FIG. 10 to the position shown in FIG. 20 so that it is released from the opening-and-closing control member 36. At the same time, the control member 36 is rotated counterclockwise about the shaft 35 by the resilience of the springs 38 and is then stopped by the pin 39 in FIG. 20. In other words, the cam portion 36*a* of the control member 36 is retracted from the rotation path of the bent end 19*a* of the follower lever 19. Furthermore, by the counterclockwise rotation of the limiting lever 42, the pin 46 of the limiting lever 42 is moved from the position shown in FIG. 18 to the position shown in FIG. 20 and pushes the operation arm 51*a*, and accordingly the scraper means 51 is rotated clockwise about the shaft 48 so that the separation fingers 51*c* are retracted from the peripheral surface of the drum 1.

Figure 21:
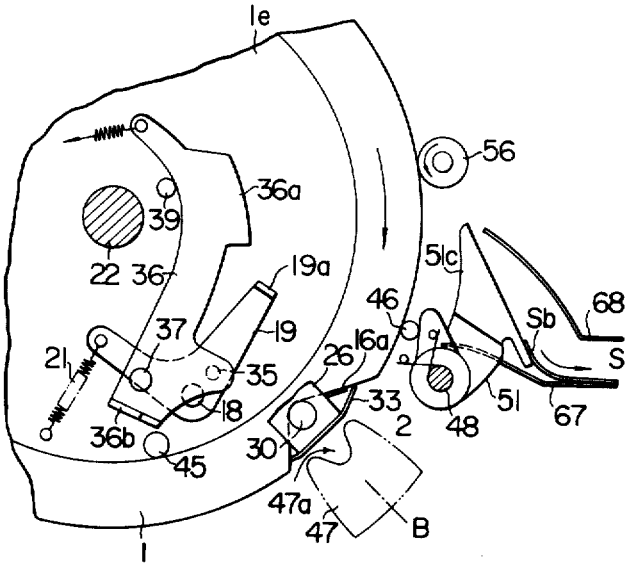
FIG. 21 is a partial schematic elevation of the photoconductor sheet clamp apparatus when the pins of the back end clamp member are dropped into the recess and the photoconductor sheet is discharged after the drum is rotated two times from the position shown in FIG. 9.

When the drum 1 is rotated from the position shown in FIG. 19 to the position shown in FIG. 20 and reaches the position shown in FIG. 21, namely when the drum 1 is rotated exactly two times from the position B, the pins 30 of the back end clamp member 26 are engaged in the bottom ends of the V-shaped recess 1*a*, and the drum 1 is stopped at this position. While the drum 1 is rotated, since the cam portion 36*a* of the control member 36 shown in FIG. 20 is retracted from the rotation path of the bent end 19*a* of the follower lever 19, the cam portion 36*a* is not engaged with the bent end 19*a*. Thus, the front end clamp member 16 is not opened again. This point will be described in more detail later. As shown in FIG. 20, the used photoconductor S, with trailing end portion Sb unclamped, is guided over the separation fingers 51*c* in the discharging direction of the photoconductor S and then is discharged along the upper surface of the door 66 to the outside of the copying apparatus.

Thus, the photoconductor S which has been wound around the drum 1 is discharged from the drum 1.

Figure 22:
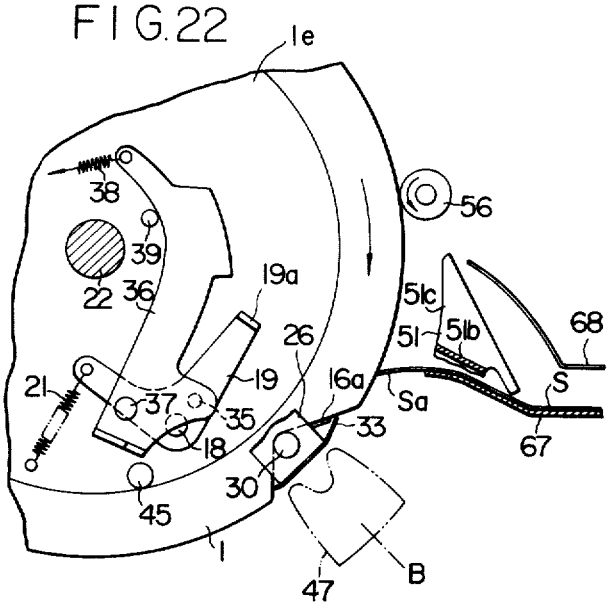
FIG. 22 is a partial schematic elevation of the photoconductor sheet clamp apparatus when the leading edge of the photoconductor is brought into contact with the peripheral surface of the drum for supplying the photoconductor sheet.

Next, a procedure of winding a fresh photoconductor around the drum 1 will be described below. The clamp means 2 of the drum 1 is stopped at the position B for exchanging the used photoconductor for a fresh one as shown in FIG. 21. Namely, the clamp means 2 located at the position B is ready for receiving a fresh photoconductor. The other movable elements are in the respective positions shown in FIG. 9. The respective movements of the movable elements when a fresh photoconductor is supplied are exactly the same as when the used photoconductor is discharged. As shown in FIG. 22, a fresh photoconductor S is inserted along the upper side of the door 66 and the guide plate 67 so that the leading end portion Sa of the photoconductor S is caused to come in contact with the peripheral surface of the drum 1, and by pushing a button (not shown) for loading or unloading a photoconductor or by actuating leading-end-detecting means (not shown) for detecting the leading end portion Sa, the solenoid 44 shown in FIG. 9 is energized so that the limiting lever 42 is rotated clockwise in the same manner as mentioned previously. Accordingly, the opening-and-closing control member 36 is rotated clockwise about the shaft 35 by the pin 45 as shown in FIG. 10.

Figure 23:
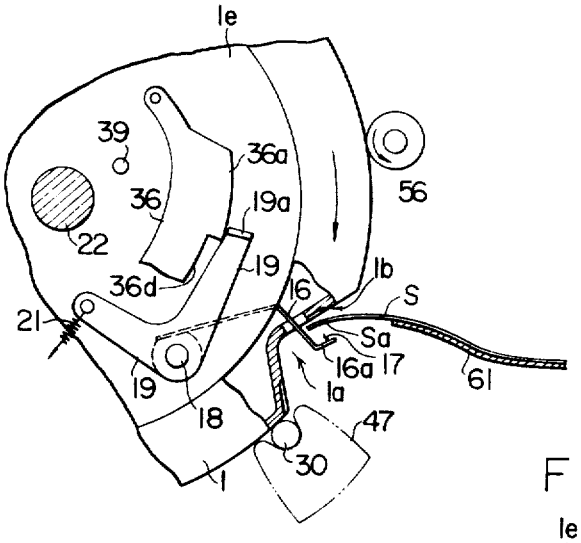
FIG. 23 is a partial schematic elevation of the photoconductor sheet clamp apparatus when the leading end portion of the photoconductor sheet is inserted between the inclined wall of the recess and the opened front end clamp member.
Figure 24:
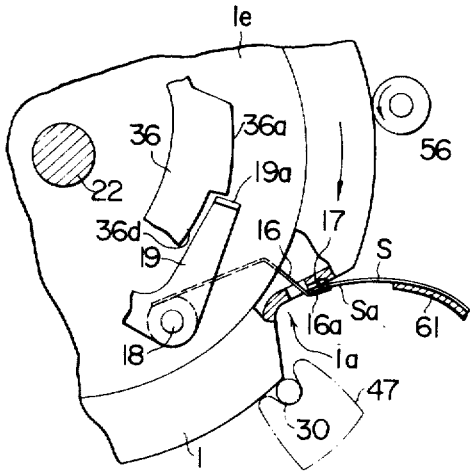
FIG. 24 is a partial schematic elevation of the photoconductor sheet clamp apparatus when the leading end portion of the photoconductor is clamped.
Figure 25:
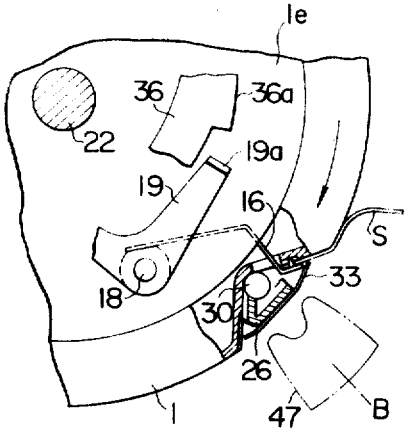
FIG. 25 is a partial schematic elevation of the drum when the pins of the back end clamp member of FIG. 24 are dropped into the recess.
Figure 26:
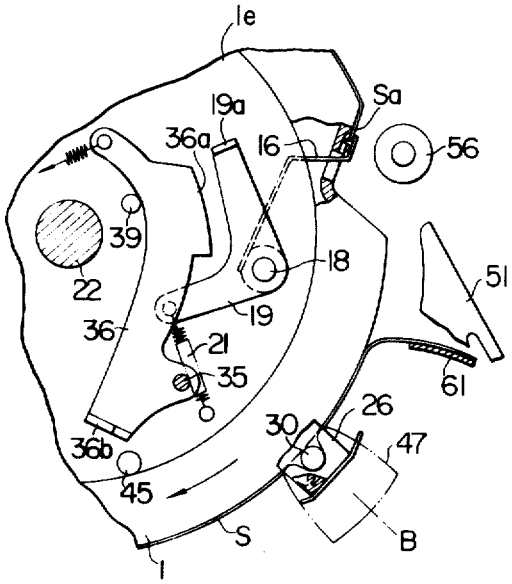
FIG. 26 is a partial schematic elevation of the photoconductor sheet clamp member when the drum is rotated further from the position shown in FIG. 25.

The cam portion 36*a* of the control member 36 reaches the rotation path of the bent end 19*a* of the follower lever 19 as shown in FIG. 11. When the drum 1 is rotated to the position shown in FIG. 16, the front end clamp member 16 is opened. With a further rotation of the drum 1 to the position shown in FIG. 23, the photoconductor S whose leading end Sa has been in contact with the peripheral surface of the drum 1 is advanced further, so that the leading end Sa is inserted between the fingers 16*a* and the inclined wall 1*b*. From this position, the drum 1 is further rotated to the position shown in FIG. 24 where the bent end 19*a* of the follower lever 19 is dropped to a cam portion 36*d* from the cam portion 36*a*. At this moment, the clamp nails 17 of the front end clamp member 16 pierce the leading end portion Sa of the photoconductor S so that the leading end portion Sa is clamped. After the leading end portion Sa of the photoconductor S is clamped by the front end clamp member 16, the pin 30 of the back end clamp member 26, as shown in FIG. 24 are dropped to the bottom end of the V-shaped recess 1*a* as shown in FIG. 25. When the pins 30 climb the peripheral tracks 1*d* of the drum 1, in other words, when the V-shaped recess 1*a* passes the stop position B, the solenoid 44 is deenergized so that the control member 36 is rotated counterclockwise about the shaft 35 until it comes in contact with the pin 39. Therefore, the cam portion 36*a* of the control member 36 is retracted from the rotation path of the bent end 19*a* of the follower lever 19. Thus, while the drum 1 is rotated from the position shown in FIG. 25 to the position shown in FIG. 26, the bent end 19*a* of the follower lever 19 is not engaged with the cam portion 36*a* of the control member 36. Accordingly, the front end clamp member 16 which clamps the leading end portion Sa of the photoconductor S is not opened again.

Figure 6:
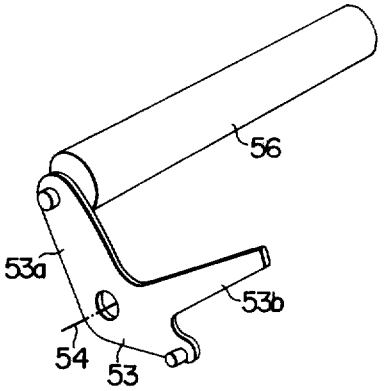
FIG. 6 is a perspective illustration of a discharge roller and supporting levers (one supporting lever is not shown), which support the discharge roller according to the invention.
Figure 7:
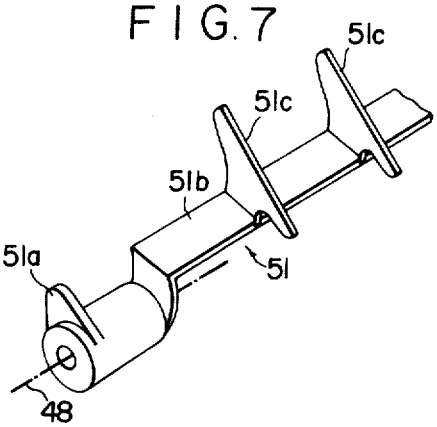
FIG. 7 is a perspective illustration of scraper means according to the invention.
Figure 27:
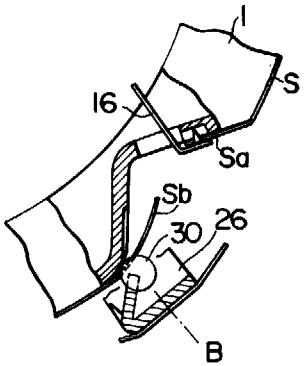
FIG. 27 is a partial schematic side elevation of the drum just before the trailing end portion of the photoconductor is clamped.
Figure 28:
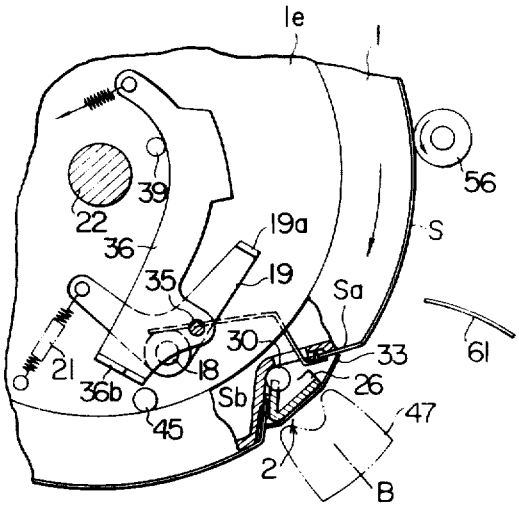
FIG. 28 is a partial schematic elevation of the photoconductor sheet clamp member when both the leading end portion and the trailing end portion of the photoconductor are clamped.

The drum 1 makes one revolution from the position shown in FIG. 22 for receiving a photoconductor S, and the pins 30 are dropped to the bottom ends of the V-shaped recess 1*a*. With a further rotation, the drum 1 is rotated to the position shown in FIG. 26 and then to the position shown in FIG. 27. At the second rotation, the pins 30 are dropped again to the bottom ends of the V-shaped recess 1*a* as shown in FIG. 28, whereby the trailing end portion Sb of the photoconductor S is clamped by the back end clamp member 26. Thus, both end portions Sa, Sb of the photoconductor S are clamped. After the trailing end portion Sb is clamped in FIG. 28, the drum 1 is rotated, with this clamping action continued, from the position shown in FIG. 28 to the position shown in FIG. 2, integrally with the follower lever 19, and with the back end clamp member 26 that has been stopped so far, and also with the control member 36. Thus, the drum 1 is stopped at the position A shown in FIG. 2. In other words, the clamp means 2 on the drum 1 is stopped at the normal stop position A for copying. At this position, when the door 66 that has been opened horizontally as shown in FIG. 6 is closed upright as shown in FIG. 2, the sliding plate 58 is caused to slide downwards by the resilience of the spring 62, and the pin 59 of the sliding plate 58 is brought into pressure contact with the other arm 53*b* of the supporting lever 53, whereby the supporting lever 53 is turned clockwise about the shaft 54. Thus, the discharge roller 56 is retracted from the peripheral surface of the drum 1. At this moment, the other movable elements are returned to their respective original positions shown in FIG. 2. Thus, the fresh photoconductor is wound around the drum so as to be ready for the next copying.

Referring now back to FIG. 3, when the photoconductor S is clamped or unclamped, the back end clamp member 26 has to be moved in the radial direction of the drum 1 with the rotation of the drum 1 while the back end clamp member 26 is stopped by the pin 37.

Figures 29, 30:
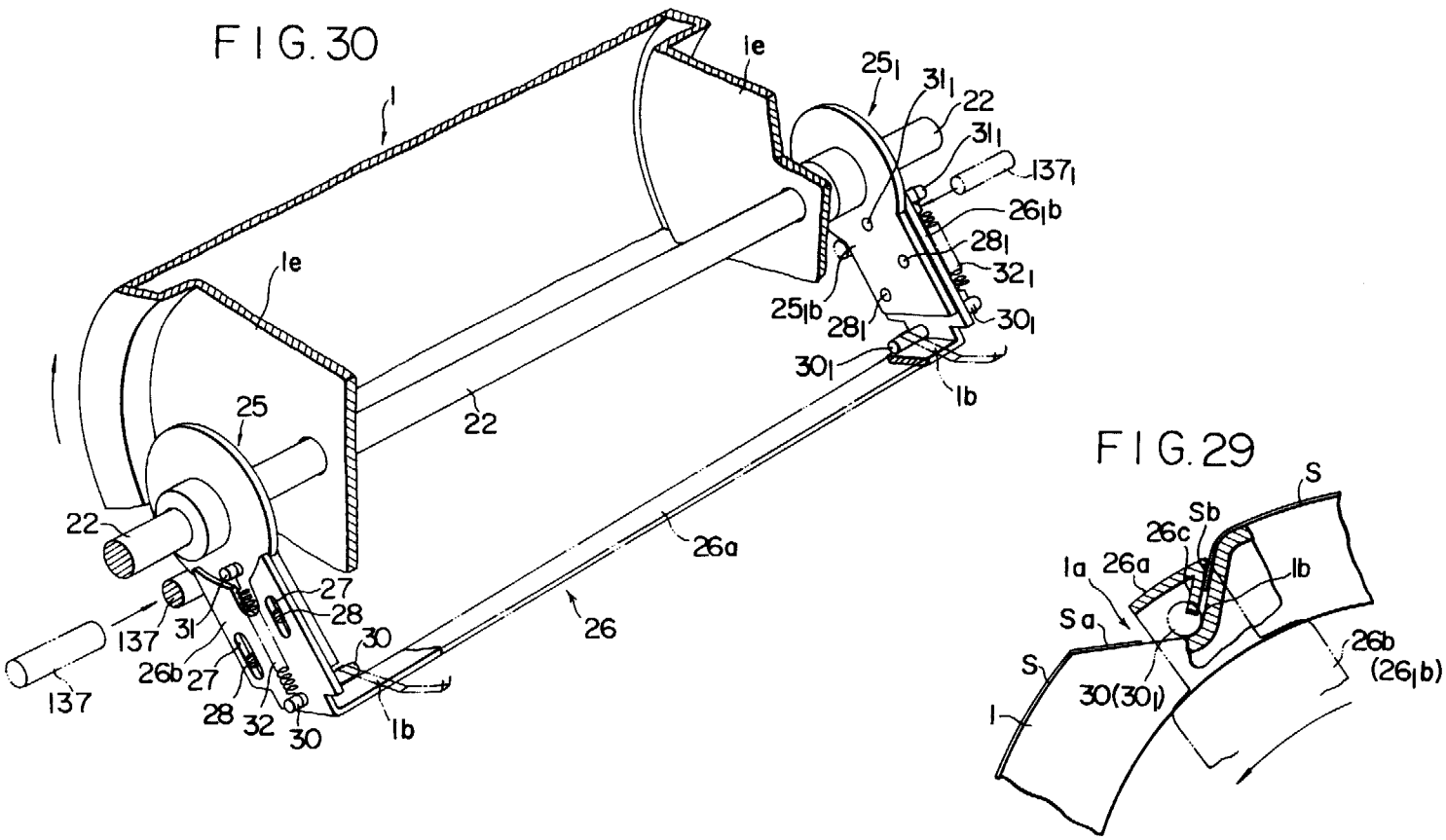
FIG. 29 is a partial schematic side elevation of the recess formed on the drum when one end portion of the photoconductor sheet is clamped by the back end clamp member and the other portion of the photoconductor sheet is wound around the drum.
FIG. 30 is a perspective illustration of a mechanism for moving the back end clamp member around the drum.

In order to do this, another back end clamp member operation means or mechanism is conceivable as described below. Referring to FIG. 30, instead of the pin 37 in FIG. 3, there is provided a stop pin 137 which is moved in the direction of the arrow by a stop pin operation mechanism (not shown) when one end of the photoconductor S is unclamped so that the support arm plate 25 is stopped by the stop pin 137 and the back end clamp member 26 is moved in the direction of the peripheral surface of the drum 1. Namely, when the photoconductor S is unclamped, the stop pin 137 is projected so as to hinder the rotation of the support arm plate 25. Even if the rotation of the support arm plate 25 is thus hindered, since the support arm plate 25 is pivotally mounted on the shaft 22, the drum 1 can be further rotated clockwise together with the shaft 22. Therefore, the inclined surface 1*b* is relatively moved with respect to both the stopped support arm plate 25 and the support arm plate $25_1$ (counterpart of the support arm plate 25) which is substantially stopped by the support member 26*a* connecting the support arm plates 25, $25_1$. Therefore, pins 30, 30 are caused to climb the inclined wall 1*b* against the resilience of springs 32, $32_1$. Accordingly, the clamping portion 26*c* of the back end clamp member 26 in FIG. 29 is moved together with the pins 30, 30 radially outwardly of the drum 1. Thus, one end of the photoconductor is unclamped.

In order to make the above-mentioned rotation of the back end clamp member 26 smoothly, it will be desirable to provide another stop pin $137_1$ for stopping the support arm plate $25_1$ on an opposite side of the stop pin 137. This is because, unless the stop pin $137_1$ is provided, there is a risk that a uniform force cannot be applied to the support member 26*a* of the back end clamp member 26, with the result that the support member 26*a* is twisted. To be more specific, unless the stop pin $137_1$ is provided, a force for hindering the rotation of the support arm plate $25_1$, that is, a force necessary for the pin 30 to climb the inclined wall 1*b* is not transmitted from the support arm plate 25 to guide pins 28, 28 to the sliding plate 26*b* to the support member 26*a* to the pin $30_1$. Under this condition, it may happen that the support member 26*a* cannot transmit the force necessary for the pin $30_1$ to climb the inclined wall 1*b* so that the support arm plate $25_1$ is more rotated clockwise than the support arm plate 25, with the support member 26*a* twisted. As a result, the clamping of the photoconductor S by the clamping portion 26c will become impossible thereafter.

However, in order to provide the other stop pin $137_1$ besides the stop pin 137, it also becomes necessary to provide an accessory apparatus for the pin $137_1$, for instance, a pin driving apparatus comprising at least a solenoid and cam means in combination, which projects or draws in the pin $137_1$ selectively at a predetermined position. This is, however, physically difficult in the case of ordinary copying machines since little space for the pin driving apparatus is left therein. Furthermore, such apparatus will make the copying machines complex in mechanism and higher in cost.

In the present invention, an improved drive transmission apparatus which eliminates the above-mentioned drawback is provided. To be more specific, in the drive transmission apparatus, by providing, for example, only the stop pin 137 for stopping the support arm plate 25, and an accessory apparatus which projects or draws in the pin 137 selectively at a predetermined position, and without providing another stop pin $137_1$ and an accessory apparatus thereof at an opposite position of the pin 137, the same effect of stopping the support arm plates 25, $25_1$ can be obtained, without giving any torsional moment to the support member 26a, as when the support arm plates 25, $25_1$ are stopped by both stop pins 137, $137_1$, respectively.

Figures 31, 34:
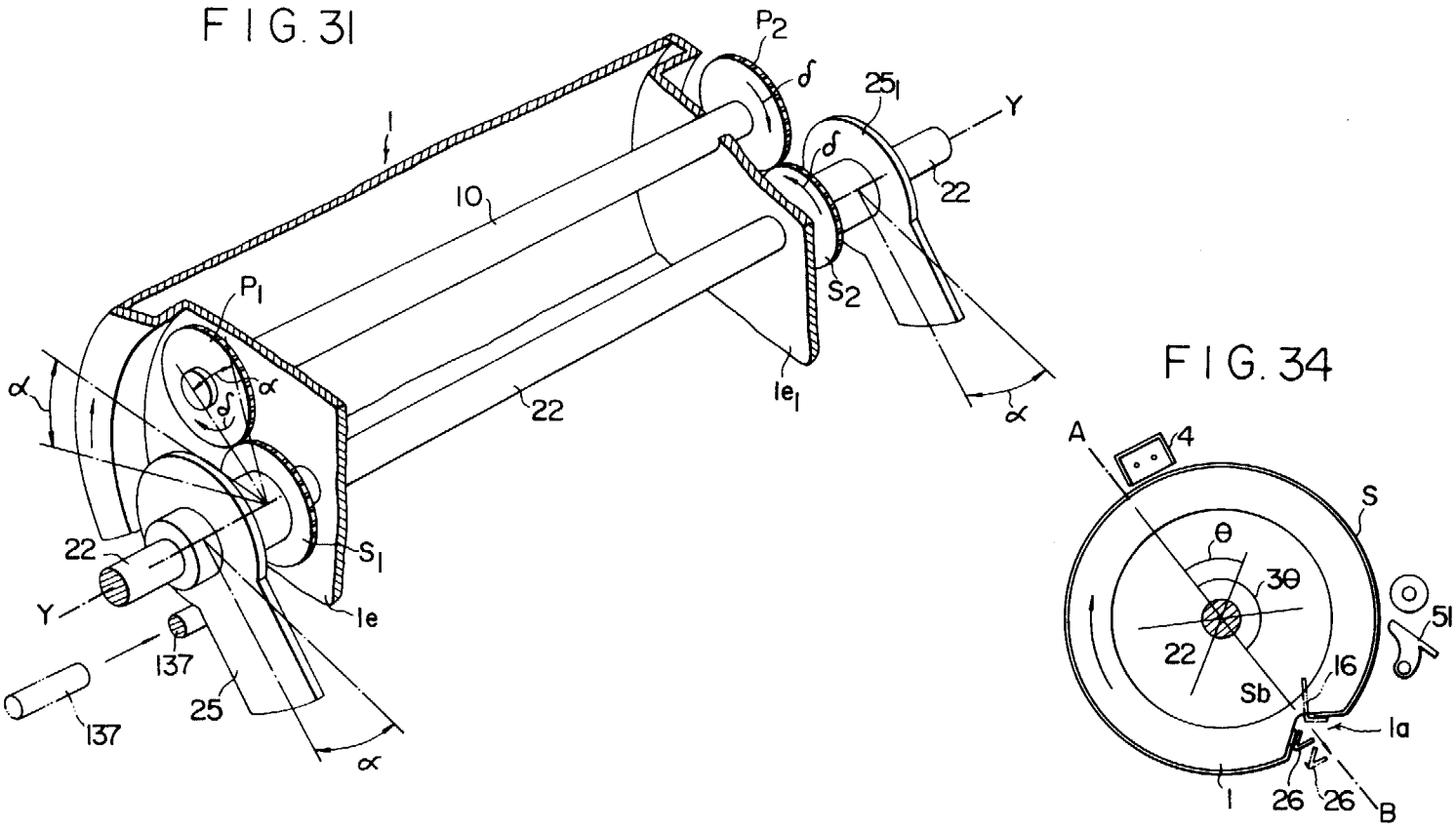
FIG. 31 is a perspective illustration of a principle of an embodiment of a drive transmission apparatus according to the present invention.
FIG. 34 and 35 are schematic illustrations of the functions of an embodiment of a drum stopping apparatus according to the invention.

FIG. 31 shows the principle of the improved drive transmission apparatus of the invention. An alternate form for the back end clamp member operation means is shown which comprises epicyclic gear trains to be described. In FIG. 31, the drum 1 is fixedly mounted on the shaft 22 which passes through both side walls 1e, 1e of the drum 1. Closely adjacent the outer side of the side wall 1e, a sun gear S1 and the support arm 25, which is integral with the sun gear S1, are rotatably mounted on the shaft 22, but their movement in the axial direction of the shaft 105 is prevented by conventional techniques. In the exact same manner as the attachment of the sun gear S1 and the support arm plate 25 to the shaft 22, a sun gear S2 and the support arm plate $25_1$ are mounted on the shaft 22 on the outer side of the side wall 1e. Moreover, a support shaft 10 is disposed parallel to the shaft 22 so as to pass through both of the side walls 1e, $1e_1$.

The support shaft 10 is rotatably bridged between the side walls 1e, $1e_1$. Furthermore, planetary gears P1, P2 are fixed to opposite ends of the support shaft 10. These planetary gears P1, P2 are engaged with the sun gears S1, S2, respectively. The sun gears S1 and S2 have the same number of teeth, and the planetary gears P1 and P2 also have the same number of teeth, respectively.

Supposing that the support arm plate 25 is stopped by the stop pin 137, and the respective relative positions of the other members shown in FIG. 31 are their original positions, the respective movements of the members are as follows.

(1) When the drum 1 is rotated clockwise by $\alpha$ degrees from its original position about the axis Y—Y of the shaft 22, from the viewpoint of the relationship between the drum 1 and the support arm plate 25, the above-mentioned rotation of the drum is considered to be identical with the counterclockwise rotation of the support arm plate 25 by $\alpha$ degrees with respect to the drum 1. Hereinafter, the action of each member is described supposing that the drum 1 is rotated clockwise by $\alpha$ degrees from its original position.

(2) In accordance with the clockwise rotation of the drum 1 by $\alpha$ degrees from its original position, the shaft 22 is also rotated clockwise about the axis Y—Y by $\alpha$ degrees. At the same time, the planetary gear P1 is rotated clockwise around the sun gear S1 and on its own axis by the distance corresponding to the rotating angle $\alpha$. When the planetary gear P1 is rotated on its own axis in engagement with the sun gear S1 and accordingly around the sun gear S1, and the rotated number of teeth of the planetary gear P1 is supposed to be $\delta$, the planetary gear P1 is rotated clockwise in engagement with the sun gear S1 by the distance corresponding to $\delta$ teeth. This means that when the sun gear S1 is rotated by $\delta$ teeth in terms of the number of teeth, the sun gear S1 is rotated by $\alpha$ degrees which is identical to $\delta$ teeth of the sun gear S1.

(3) On the side of the side wall 1e, the planetary gear P1 functions as a follower gear of the sun gear S1 as the result of the rotation of the drum 1 in (1). On the other hand, on the side of the side wall $1e_1$, the planetary gear P2 which is substantially integral with the planetary gear P1 functions as a driving gear of the sun gear S2. Therefore, the planetary gear P2 makes the exact same movement as the planetary gear P1 with respect to a common reference member thereof, for instance, the drum 1. In other words, by rotating the drum 1 clockwise by $\alpha$ degrees from its original position, with the support arm plate 25 stopped by the stop pin 137, the sun gear S2 is rotated counterclockwise by $\delta$ teeth from its original position by the planetary gear P2. Accordingly, both the sun gear S2 and the support arm plate $25_1$ which is substantially integral with the sun gear S2 are rotated counterclockwise by $\delta$ degrees with respect to the drum 1.

(4) Therefore, taking into consideration the description in (1), the support arm plates 25, $25_1$ are rotated counterclockwise about the axis Y—Y by $\alpha$ degrees with respect to the drum 1.

As mentioned from (1) through (4), in the present improved drive transmission apparatus, the relative movement of the support arm plate 25 with respect to the drum 1 is transmitted from the support arm plate 25 to the sun gear S1 to the planetary gear P1 to the support shaft 10 to the planetary gear P2 to the sun gear S2 to the support arm plate $25_1$, and the moved angle of both support arm plates 25, $25_1$ with respect to the drum 1 is the same so long as the number of teeth of the planetary gear P1 and that of the gear P2 are equal, and the number of teeth of the sun gear S1 and that of the gear S2 are equal.

By making an appropriate combination of the ratio of the number of teeth of the planetary gears P1, P2 to that of the sun gears S1, S2, the moved angle of the support arm plates 25, $25_1$ with respect to the drum 1 can be changed.

Figure 32:
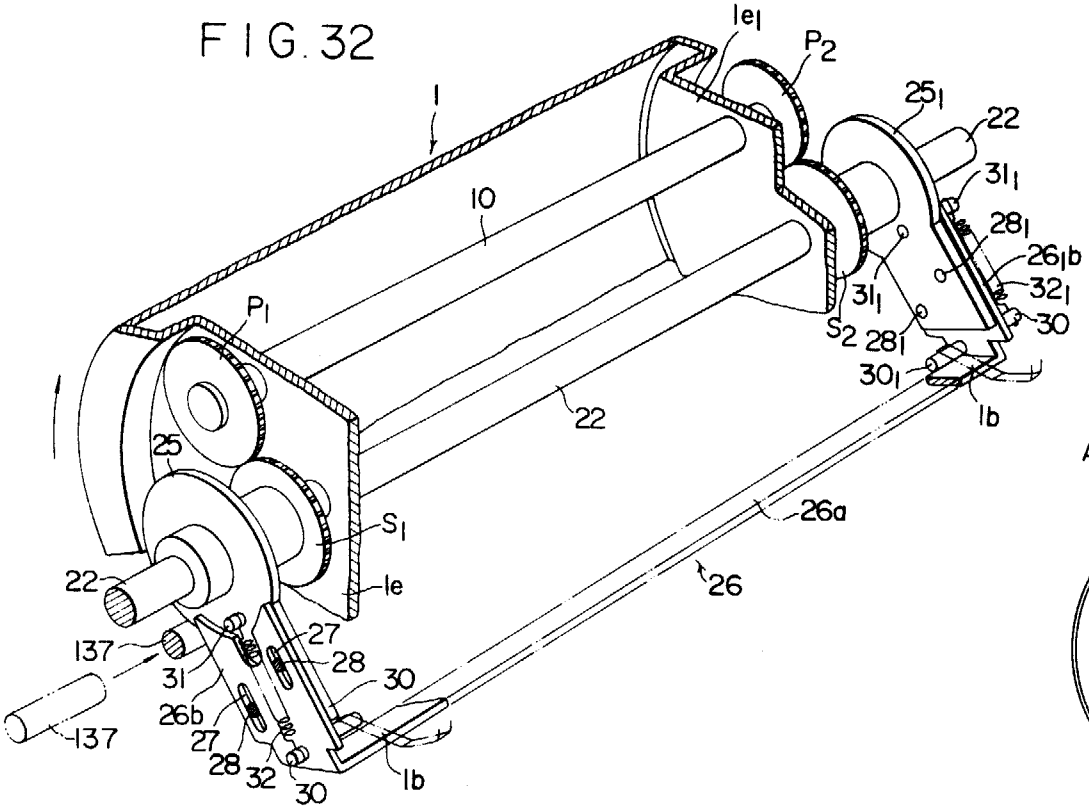
FIG. 32 is a perspective illustration of the embodiment of the drive transmission apparatus of FIG. 31.

Referring to FIG. 32, there is shown a sheet clamping apparatus in which the above-mentioned improved drive transmission apparatus is employed. To be more specific, in FIG. 32, the drive transmission apparatus in FIG. 31 is applied to the sheet clamp apparatus shown in FIGS. 29 and 30. In FIG. 32, the sun gears S1, S2 are respectively engaged with the planetary gears P1, P2 and the planetary gears P1, P2 are fixed to the support shaft 10.

The support arm plates 25 and $25_1$ are connected by the back end clamp member 26 as in FIG. 30.

Of the reference numerals used in FIG. 32, the same reference numerals as in FIGS. 29, 30 and 31 indicate the members which are substantially identical in shape, construction and action with those in FIGS. 29, 30 and 31. When the support arm plate 25 is stopped by the pin 137, with the pins 30, $30_1$ in contact with the inclined wall 1b, and the drum 1 is rotated clockwise by α degrees with respect to the support arm plate 25, the pins 30, $30_1$ are relatively rotated counterclockwise by α degrees about the shaft 22 with respect to the drum 1. Thus, the pins 30, $30_1$ are caused to climb the inclined surface 1b against the resilience of the springs 32 and $32_1$. At the same time, the counterclockwise rotation of the support arm plate 25 by α degrees with respect to the drum 1 is transmitted from the sun gear S1 to the planetary gear P1 to the support shaft 10 to the planetary gear P2 to the sun gear S2 to the support arm plate $25_1$, so that the pins 30, $30_1$ are rotated counterclockwise by α degrees about the shaft 22 with respect to the drum 1. The reason for this has been already explained relating to FIG. 31.

Therefore, by one stop pin, for instance, by the stop pin 137 disposed on the side wall 1e, the relative movement of the support arm plate 25 with respect to the drum is transmitted to the support arm plate $25_1$ without being transmitted through the support member 26a of the back end clamp means.

In the present drive transmission apparatus, the drive transmission means between the sun gear S1 and the planetary gear P1 and that between the sun gear S2 and the planetary gear P2 are not limited to the gears as explained in FIG. 32, but other means equivalent to the gears, such as belts and chains, can be employed as well.

Figure 33:
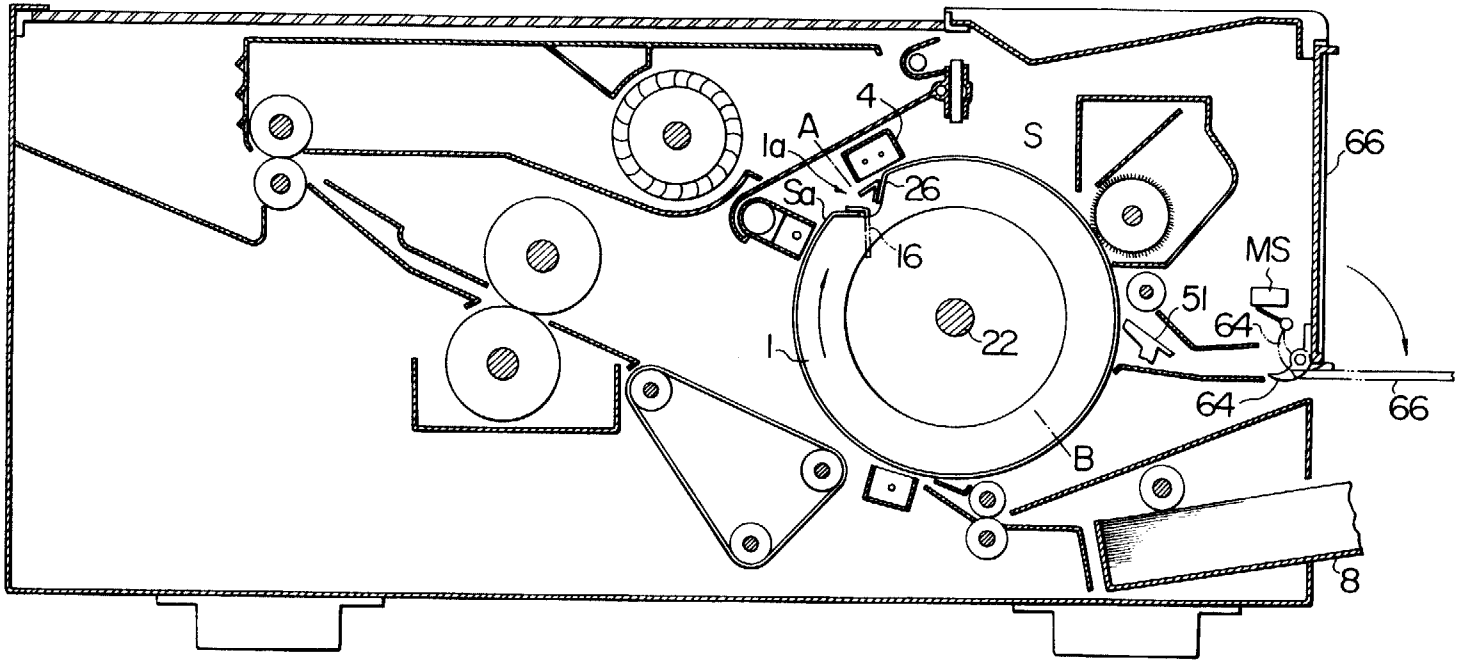
FIG. 33 is a schematic sectional side elevation of an electrostatic copying machine suitable for employing an embodiment of a drum stopping apparatus according to the invention.

Referring to FIG. 33, the photoconductor S is wound around the drum 1, and the leading end portion Sa of the photoconductor S is clamped by the front end clamp member 16 while the trailing end portion Sb thereof is clamped by the back end clamp member 26. Both clamp members 16 and 26 are positioned at the recess 1a. When a copying process is over, the recess 1a is located near the charger 4 for charging the surface of the photoconductor S.

When the next copying process is initiated, the drum 1 is rotated in the direction of the arrow, and when the drum 1 has been rotated two times and when a copy to be made is one, the drum 1 is stopped, and the recess 1a is positioned at its original position A. The normal position of the recess 1a here means a position near the charger 4 so as to be capable of bringing immediately the leading end portion Sa of the photoconductor S into a charging area corresponding to the charger 4 when a copying process is initiated. In this sense, the position A is a standby position of the drum 1 to be ready for copying.

Figure 35:
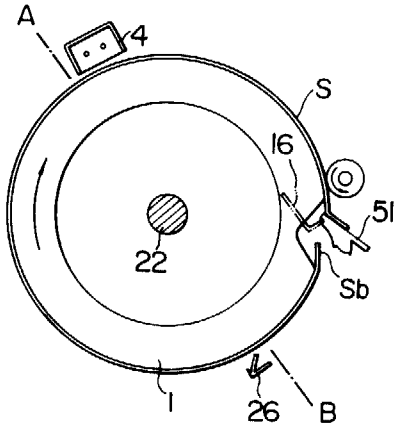

When the photoconductor S is exchanged with a fresh one, the drum 1 is rotated in the same direction of the arrow as in making copies, and is then stopped after it has been rotated from its original position, for instance, by 180 degrees. In other words, the recess 1a of the drum 1 is stopped at a position B. The position B here means a stop position for replacing the photoconductor S as shown in FIG. 34. After it is stopped at the position B, the drum 1 is further rotated in the direction of the arrow. At this moment, the back end clamp member 26, which is designed so as to clamp the trailing end portion Sb of the photoconductor S, is moved outwardly of the drum 1, that is from the position indicated by solid lines to the position indicated by long and short dash lines by a detaching-and-stopping mechanism (not shown) and is then stopped at the long and short dash line position, so that the trailing end portion SB of the photoconductor S is unclamped. About the time when the drum 1 is rotated from the position B to the position shown in FIG. 35, the front end clamp member 16 is opened as shown in FIG. 35. At the same time, the scraper means 51 is projected and separates the leading end portion Sa of the photoconductor S from the recess 1a, so that the photoconductor S is discharged from the copying machine.

Thus, the trailing end portion Sb of the photoconductor S is unclamped by the drum 1 once stopped at the position B and then rotated again. Therefore, when the photoconductor S is unclamped at the position A in FIG. 33, the unclamping movement of the back end clamp member 26 is hindered by the charger 4 since the charger 4 cannot be disposed at any other position for the afore-mentioned reason. From this point of view, it is necessary to stop the drum 1 at a position, other than the copying standby position A in order to unclamp the photoconductor S. For this reason, in the present invention, there is provided a drum stopping apparatus capable of stopping the drum 1 at any position except the above-mentioned copying standby position and accordingly capable of stopping the recess 1a at a position, for instance, the position B, other than the position A.

Figure 36:
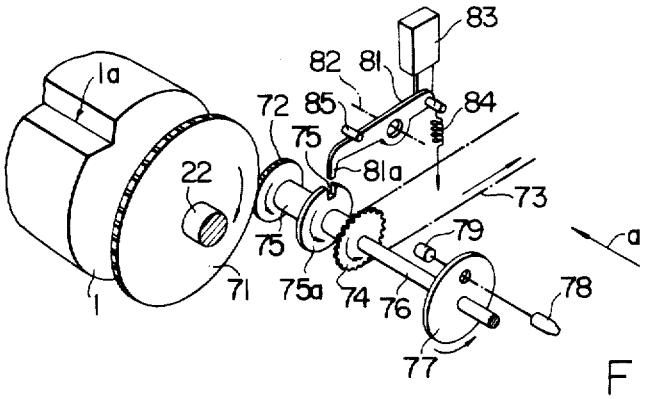
FIG. 36 is a perspective illustration of one embodiment of the drum stopping apparatus according to the invention.

Referring to FIG. 36, a large diameter gear 71 is fixedly mounted on the shaft 22 of the drum 1, and a small diameter gear 72 is engaged with the large diameter gear 71. The speed ratio of the two gears 71 and 72 is an integer. To be more specific, when the rotation speed of the small diameter gear 72 is n (where n=2, 3 4, . . . ), the rotation speed of the large diameter gear 71 is one. In other words, while the small diameter gear 72 makes one revolution, the large diameter gear 71 makes a 1/n rotation.

Supposing that the number of teeth of the large diameter gear 71 is 180 and that that of the small diameter gear 72 is 30, the ratio of the number of teeth is 6 to 1. Therefore, while the small diameter gear 72 makes six revolutions, the large diameter gear 71 makes one revolution. In other words, while the small diameter gear 72 makes one revolution, the large diameter gear 71 makes a 1/6 revolution, namely the large diameter gear 71 is rotated by 60 degrees. Between the small diameter gear 72 and a sprocket 74, there is provided a spring clutch 75 which connects or disconnects a drive transmission mechanism in collaboration with a stop lever 81 as will be described in detail later. The stop lever 81 having a stop finger 81a at one arm thereof is pivotally mounted on a shaft 82 fixed to a base plate (not shown). The other arm of the stop lever 81 is connected to a solenoid 83. The reference numeral 77 represents a counter disk fixed to a shaft 76, and the reference numeral 78 denotes a light emitting element, and the reference numeral 79 a sensor.

Referring back to FIG. 33, when the door 66 disposed on the right side of the copying machine is opened to a horizontal position in order to exchange the photoconductor S, the hinge 64 attached to the base portion of the door 66 turns on a microswitch MS. By an operation signal produced with the microswitch MS on, a driving motor (not shown) is energized so that a driving chain 73 in FIG. 36 is rotated in the direction of the arrow. In the figure, the sprocket 74 and the shaft 76 are also rotated in the direction of the arrow by the driving chain 73.

The rotation of the sprocket 74 is also transmitted to the small diameter gear 72 by the rotation transmitting function of the spring clutch 75. In other words, the small diameter gear 72, the spring clutch 75, the sprocket 74 and the counter disk 77 are integrally rotated. As mentioned previously, while the gear 72 makes one revolution, the gear 71 makes a 1/6 revolution (i.e., 60 degrees in terms of the rotating angle). Supposing that this rotating angle is $\theta$, when the gear 72 makes one revolution, the recess 1*a* of the drum 1 which has been stopped at the normal copying standby position A comes to a position shown in FIG. 34 by the rotation of $\theta$ of the drum 1.

When the gear 72 has made exactly three revolutions, namely when the gear 71 and the drum 1 have been rotated by $3\theta$ (i.e., a ½ revolution), in other words, when the recess 1*a* has reached the position B, the solenoid 83 is energized. Together with the rotation of the respective members mentioned above, the counter disk 77 is also rotated. The design of the counter disk 77 is such that light emitted from the light emitting element 78 is detected by the sensor 79, for example, three times in this case, and the pulse of the detected light is counted by conventional techniques. In accordance with this, the solenoid 83 is energized. By the solenoid 83 energized, the stop lever 81 is rotated counterclockwise, viewed from the arrow a, about the shaft 82 against the resilience of a spring 84 so that the stop finger 81*a* of the stop lever 81 is engaged with a notch 75*b* of a sleeve 75*a* of the spring clutch 75 which has returned, after three rotations, to the position facing the stop finger 81*a*. As a result, the drive transmission from the sprocket 74 to the gear 72 is disconnected, and, at the same time, the drum 1 is stopped at the position B as shown in FIG. 34. Thus, the drum stopping apparatus permits the drum 1 to be stopped at the stop position B for exchanging the photoconductor S. After the drum 1 is stopped at the position B, the solenoid 83 is deenergized, and, at the same time, the stop lever 81 is rotated to its original position. The drum 1 is driven by conventional techniques.

In the present drum stopping apparatus, the rotation speed of the gear 72 is n times that of the gear 71 (where n is an integer greater than 1), and the drum 1 is stopped at a predetermined position after the gear 72 is rotated integer times. In other words, the integer times rotations of the gear 72 signify that normally the notch 75*b* of the sleeve 75*a* of the spring clutch 75 is always positioned so as to face the stop finger 81*a*. However, unless the gear 72 is rotated integer times, the notch 75*b* cannot face the stop finger 81*a* when the sleeve 75*a* is returned by rotation. In this case, the sleeve 75*a* has to be additionally rotated to its original position for the next operation. In the present drum stopping apparatus, however, it is unnecessary to take this matter into consideration. Furthermore, the present apparatus is designed so as to stop the drum 1 at the position B as shown in FIG. 34. However, such a stop position is not limited to the position B, but it can be set at a position corresponding to the rotation of the drum 1 by, for instance, $2\theta$ or $4\theta$. Namely, the stop position can be set at any desired position so as to be convenient for discharging the photoconductive sheet wound around the drum 1.

Figure 37:
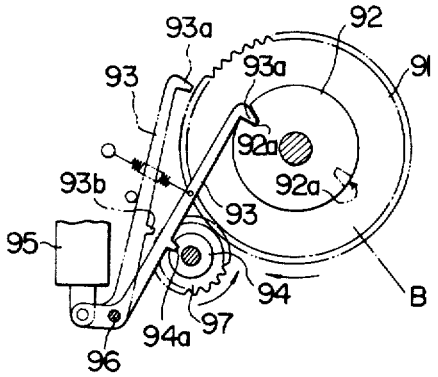
FIG. 37 is a perspective illustration of another embodiment of the drum stopping apparatus according to the invention.

FIG. 37 shows another drum stopping apparatus according to the invention. In the figure, a disk 92 having a notch 92*a* is attached to a large diameter gear 91 so as to be substantially integral with the larger diameter gear 91. Normally, a stop lever 93 is in the position indicated by long and short dash lines, and the notch 92*a* of the disk 92 is also in the position indicated by long and short dash lines. Furthermore, a notch 94*a* of a sleeve 94 is positioned so as to face a stop finger 93*b* of the stop lever 93. At this position, the sleeve 94 of the spring clutch (not shown) and a small diameter gear 97 are rotated in the direction of the arrow as in the previously mentioned drum stopping apparatus. While the gear 97 makes three revolutions, the gear 91 makes a ½ revolution, and the notch 92*a* of the disk 92 is rotated from the position indicated by long and short dash lines to the position indicated by solid lines. Just before this, a solenoid 95 is energized so that the stop lever 93 is rotated clockwise about a shaft 96 from the position indicated by long and short dash lines to the position indicated by solid lines. The stop fingers 93*a* and 93*b* are simultaneously engaged with the notch 92*a* of the disk 92 and the notch 94*a* of the sleeve 94, respectively. Thus, the drive transmission from a driving system to the gear 97 is disconnected, so that the gear 91 is stopped. In this drum stopping apparatus, since the gear 91 is directly stopped, a slippage of the stop position due to the backlash or the inaccuracy of the transmission of the rotation of the spring clutch at the time of the gear engagement can be more effectively prevented, unlike the apparatus shown in FIG. 36.

Conventionally, when the photoconductor S is wound around the drum 1, the photoconductor is held by hands and registered on a set table and inserted from there so as to be brought into contact with a clamp member for clamping the photoconductor S. Then by turning the drum 1, the photoconductor S is wound around the drum 1. However, since the photoconductor S is directly handled by hands in this method of loading, the photoconductor S is apt to be smeared, and the registration of the photoconductor S is not always constant, so that the loading of the photoconductor S becomes imperfect, resulting in that the photoconductor S is damaged. Moreover, once the photoconductor S is jammed, removal thereof is difficult. Therefore, in the invention, there is provided an apparatus capable of winding the photoconductor S around the drum 1 or a belt securely and easily without touching the photoconductor S directly.

Figure 38:
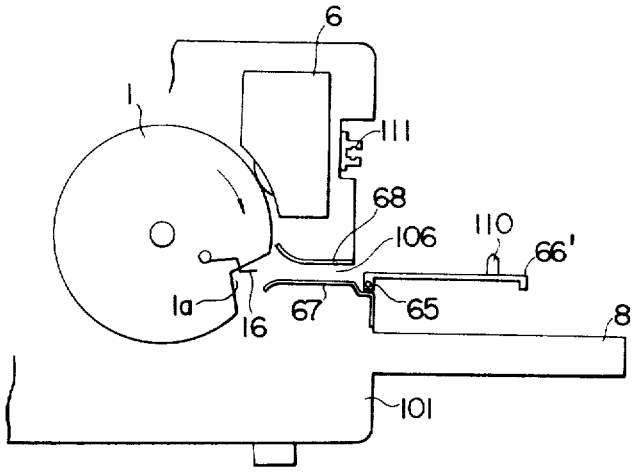
FIG. 38 is a schematic sectional side elevation of an electrophotographic copying machine whose set table is opened and in which a photoconductor sheet loading apparatus according to the invention is employed.

FIG. 38 shows a schematic side elevation of the main portion of a photoconductor sheet loading apparatus employed in an electrophotographic copying machine 101 according to the invention. In the figure, the reference numeral 6 represents the development apparatus; the reference numeral 8 a cassette for holding a supply of transfer sheets; the reference numeral 1 a drum having a front end clamp member 16 for clamping the photoconductor S to the drum 1. The inlet portion 106 for inserting the photoconductor S therethrough is provided with guide plates 67, 68 for guiding the inserted photoconductor S. At the outside of the inlet portion 106, there is disposed a set table 66' whose one end portion is rotatably supported by the shaft 65. On the set table 66', there are disposed engagement members 110 which are engageable in registration portions 115 formed in a package of the photoconductor sheet (refer to FIGS. 41 (A) and (B)). The set table 66' can be fixed to the table catches 111 by turning the set table 66' to table catches 111 attached to one side of the copying machine 101. Except when the photoconductor S is loaded, the set table 66' is turned upright so as to be fixed to the table catches 111. Therefore, the registration portions 115 formed in the package of the photoconductor S, the engagement members 110 disposed on the set table 66', and the table catches 111 attached to the electrophotographic copying machine 101 are correlated in their respective positions so as to be engageable in each other. FIG. 40 shows a schematic side elevation of the main portion of the photoconductor sheet loading apparatus of FIG. 39 when the photoconductor S is being clamped to the drum 1.

Figure 41B:
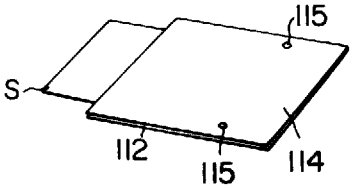
FIG. 41 (A) is a perspective illustration of a photoconductor sheet loading package before it is opened, which package is for use with the photoconductor sheet loading apparatus.
Figure 41A:
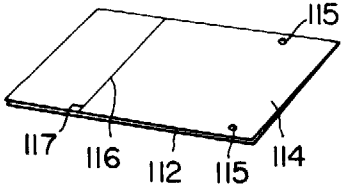

Referring to FIG. 41 (A), there is shown a photoconductor sheet loading package 112 which is not opened yet. An opening string 116 for opening a photoconductor package 114 is attached to the package 114. By pulling a free end 117 of the string 116, the photoconductor package 114 can be opened easily as shown in FIG. 41 (B). In the opposite side portions of the photoconductor package 114, there are formed the registration portions 115 with which the engagement members 110 are to be engaged. As shown in FIG. 41 (B), by opening the photoconductor sheet loading package 112, a part of the photoconductor S comes out from the loading package 112.

Figure 39:
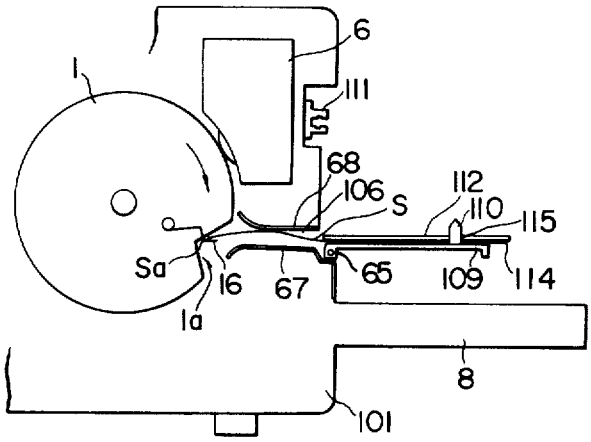
FIG. 39 is a schematic sectional side elevation of the electrophotographic copying machine when a photoconductor sheet is loaded on a drum.
Figure 40:
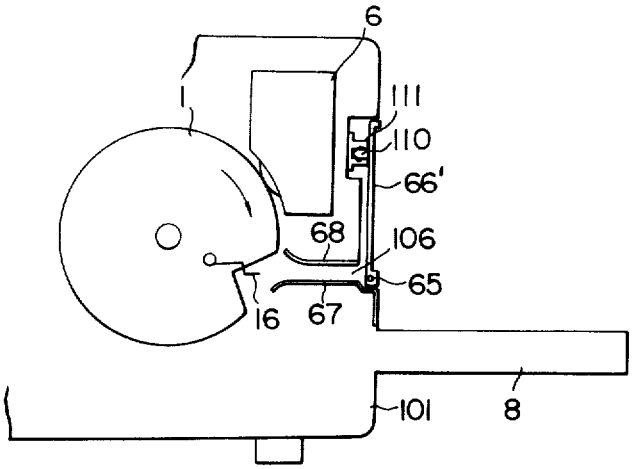
FIG. 40 is a schematic sectional side elevation of the electrophotographic copying machine when the set table of FIG. 38 is closed.

Referring now back to FIG. 39, the leading end portion Sa of the photoconductor S projecting from the loading package 112 is inserted into an inlet 106 so as to be guided by the guide members 67, 68 and is then brought into contact with the front end clamp member 16 disposed in the recess 1*a* of the drum 1. The other end of the photoconductor sheet loading package 112 is then set on the set table 66' in order that the registration portions 115 formed on both sides of the photoconductor package 112 are engaged with the engagement members 110. Thus, the loading package 112 is set on the set table 66'. At this moment, the leading end Sa of the photoconductor S is in contact with the clamp member 16 so that the photoconductor S is slightly bent between the clamp member 16 and the inlet 106 since the portion of the photoconductor S between the clamp member 16 and the inlet 106 is set so as to be slightly longer than the path between the clamp 16 and the inlet 106. Thus, a secure winding of the photoconductor S around the drum 1 can be accomplished. With this arrangement, when the drum 1 is rotated in the direction of the arrow, the slightly bent portion of the photoconductor S is moved together with the clamp member 16. While the photoconductor S is slightly bent, it is securely wound around the drum 1.

FIG. 40 is a schematic sectional side elevation of the main portion of the photoconductor sheet loading apparatus of FIGS. 38 and 39 when the set table 66' is closed upright. By turning the set table 66' about the shaft 65 at one end of the set table 66', the set table 66 can be closed with the engagement members 111 engaged with the table catches 111, so that the set table 66 can form a side portion of the copying machine 101 so as to be flush with the other portion of the copying machine 101. This arrangement serves not only to facilitate the operation of the copying machine but also to prevent light from entering the copying machine since the inlet 106 is closed tightly by the set table 66'. Thus, the set table 66 serves as a door of the inlet 106.

The registration portions 115 formed in the sheet loading package 112, which are to be engaged with the engagement members 110 of the set table 66', can be made in any form such as circle, triangle, square, and polygon, so long as the registration of the photoconductor sheet loading package 112 can be made securely. Any number of the registration portions 115 can be formed so long as a secure registration is performed. The registration portions 115 and the engagement members 110 have to be designed so as to remain engaged with each other when the photoconductor S is wound around the drum 1. Otherwise, the sheet loading package 112 is drawn into the inlet 106 together with the photoconductor S. Of course, when opening the sheet loading package 112, any method can be employed so long as it is capable of opening the package 112 from its middle portion.

While specific embodiments of the invention have been shown and described in detail to illustrate the application of the principles of the invention, it will be understood that the invention may be embodied otherwise without departing from such principles.

What is claimed is:

1. A photoconductor sheet clamp apparatus comprising, in combination, a drum adapted to have a photoconductor sheet wound therearound, and having a recess, at one part of its peripheral surface, extending along a generating line of said peripheral surface; a drum shaft about which said drum is rotatable; a front end clamp member in said recess and operable to clamp the leading end portion of a photoconductor sheet into said recess; front end clamp member operation means operable on said front end clamp member to clamp and unclamp the leading end portion of a photoconductor sheet; a back end clamp member operable to clamp the trailing end portion of a photoconductor sheet in said recess, said back end clamp member being disengageable from said recess and rotatable around the axis of said drum shaft independently of said drum; back end clamp member operation means operable to move said back end clamp member relative to said drum; leading end separation guide means operable to separate the leading end portion of a photoconductor sheet from said drum for discharge of a photoconductor sheet; and drum stopping means operable to stop said drum at a predetermined angular position for unclamping a photoconductor sheet from said drum for discharge of a photoconductor sheet, said drum stopping means comprising a gear train including at least two gears, with a first gear being fixably mounted on said drum shaft to rotate as a unit with said drum, and a driving shaft fixably mounting a second gear engaged with said first gear; driving means mounted on said driving shaft; and stop means operable to interrupt transmission of motion from said driving means to said second gear.

2. A photoconductor sheet clamp apparatus as claimed in claim 1, wherein said front end clamp member has a plurality of fingers arranged along a generating line of said peripheral surface for clamping the leading end portion of the photoconductor sheet.

3. A photoconductor sheet clamp apparatus as claimed in claim 1, wherein said back end clamp operation means comprises stopper means for stopping said back end clamp member.

4. A photoconductor sheet clamp apparatus as claimed in claim 1, wherein a plate is fixed to the upper portion of said back end clamp member so as to be engageable in said recess.

5. A photoconductor sheet clamp apparatus as claimed in claim 1, wherein said stop means comprises a spring clutch, having a notch therein, disposed between said second gear and said driving means, and a stop lever having at least one stop finger engageable in said notch of said spring clutch.

6. A photoconductor sheet clamp apparatus as claimed in claim 1, wherein the rotation ratio of said first gear to said second gear is 1:n, where n is an integer greater than 1.

7. A photoconductor sheet clamp apparatus, as claimed in claim 1, in which said recess comprises at least two oppositely inclined walls extending along a generating line of the peripheral surface of said drum; said front end clamp member being operable to clamp the leading end portion of a photoconductor sheet to one of said oppositely inclined walls and said back end clamp member being operable to clamp the trailing end portion of the photoconductor sheet to the other of said oppositely inclined walls.

8. A photoconductor sheet clamp apparatus as claimed in claim 7, wherein said wall for clamping the leading end portion of the photoconductor sheet thereto has at least one window which allows said front end clamp member to pass therethrough.

9. A photoconductor sheet clamp apparatus as claimed in claim 7, wherein said walls for clamping the leading end portion of the photoconductor sheet thereto has at least one notch which allows part of said back end clamp member to be engaged therewith.

10. A photoconductor sheet clamp apparatus, as claimed in claim 1, in which said front end clamp member operation means includes a rotatable shaft and a base fixed to said rotatable shaft and connected to said front end clamp member; spring means normally biasing said rotatable shaft in the clamping direction of said front end clamp member; and cam means operable to rotate said rotatable shaft in the unclamping direction of said front end clamp member.

11. A photoconductor sheet clamp apparatus, as claimed in claim 1, in which said back end clamp comprises a pair of support arm plates rotatably mounted on opposite ends of said drum shaft, a pair of sliding plates each mounted on a respective support arm plate; guide means guiding said sliding plates for movement on the respective support arm plates radially of said drum; spring means biasing said sliding plates radially inwardly of said drum; and a support member connected between said sliding plates and engageable in said recess.

12. A photoconductor sheet clamp apparatus, as claimed in claim 1, in which said stop means comprises a disk, having a notch therein, fixably mounted on said drum shaft; a further disk, having a notch therein, fixably mounted on said driving shaft; a stop lever including two stop fingers each engageable in the notch of a respective one of said disks; and a spring clutch arranged between said further disk and said driving means.

13. A photoconductor sheet clamp apparatus comprising, in combination, a drum adapted to have a photoconductor sheet wound therearound, and having a recess, at one part of its peripheral surface, extending along a generating line of said peripheral surface; a drum shaft about which said drum is rotatable; a front end clamp member in said recess and operable to clamp the leading end portion of a photoconductor sheet into said recess; front end clamp member operation means operable on said front end clamp member to clamp and unclamp the leading end portion of a photoconductor sheet; a back end clamp member operable to clamp the trailing end portion of a photoconductor sheet in said recess, said back end clamp member being disengageable from said recess and rotatable around the axis of said drum shaft independently of said drum; back end clamp member operation means operable to move said back end clamp member relative to said drum; leading end separation guide means operable to separate the leading end portion of a photoconductor sheet from said drum for discharge of a photocondutor sheet; and drum stopping means operable to stop said drum at a predetermined angular position for unclamping a photoconductor sheet from said drum for discharge of a photoconductor sheet, said back end clamp operation means comprising epicyclic gear trains, with said epicyclic gear trains comprising a pair of sun gears fixed to respective ends of said drum shaft; a pair of support arm plates, each substantially fixed to a respective one of said sun gears, said support arm plates extending radially outwardly of said drum in the said direction relative to said drum shaft; a further shaft disposed parallel to said drum shaft, a pair of planetary gears fixed to respective ends of said further shaft and each engaged with a respective sun gear; and stopping means operable to arrest motion of one of said support arm plates; said back end clamp member extending between said pair of support arm plates along a generating line of the peripheral surface of said drum.

14. A photoconductor sheet clamp apparatus comprising, in combination, a drum adapted to have a photoconductor sheet wound therearound, and having a recess, at one part of its peripheral surface, extending along a generating line of said peripheral surface; a drum shaft about which said drum is rotatable; a front end clamp member in said recess and operable to clamp the leading end portion of a photoconductor sheet into said recess; front end clamp member operation means operable on said front end clamp member to clamp and unclamp the leading end portion of a photoconductor sheet, a back end clamp member operable to clamp the trailing end portion of a photoconductor sheet in said recess, said back end clamp member being disengageable from said recess and rotatable around the axis of said drum shaft independently of said drum; back end clamp member operation means operable to move said back end clamp member relative to said drum; leading end separation guide means operable to separate the leading end portion of a photoconductor sheet from said drum for discharge of a photoconductor sheet; and drum stopping means operable to stop said drum at a predetermined angular position for unclamping a photoconductor sheet from said drum for discharge of a photoconductor sheet, said leading end separation means comprising a rotatable shaft and a plurality of separation fingers mounted on said rotatable shaft and facing the peripheral surface of said drum; and scraper means mounted on said rotatable shaft and operable to guide said separation fingers to advance along the peripheral surface of said drum and the bottom of said recess to enter between the leading end portion of a photoconductor sheet and the peripheral surface of said drum.

15. A photoconductor sheet clamp apparatus, as claimed in claim 14, including a discharge roller mounted closely adjacent said drum, for discharging a photoconductor sheet from said drum in cooperating with said leading end separation means; and means selectively operable to bring said discharge roller into contact with said drum and to retract said discharge roller from said drum.

16. A photoconductor sheet clamp apparatus comprising, in combination, a drum adapted to have a photoconductor sheet wound therearound, and having a recess, at one part of its peripheral surface, extending along a generating line of said peripheral surface, a drum shaft about which said drum is rotatable; a front end clamp member in said recess and operable to clamp the leading end portion of a photoconductor sheet into said recess; front end clamp member operation means operable on said front end clamp member to clamp and unclamp the leading end portion of a photoconductor sheet; a back end clamp member operable to clamp the trailing end portion of a photoconductor sheet in said recess, said back end clamp member being disengageable from said recess and rotatable around the axis of said drum shaft independently of said drum; back end clamp member operation means operable to move said back end clamp member relative to said drum; leading end separation guide means operable to separate the leading end portion of a photoconductor sheet from said drum for discharge of a photoconductor sheet; and drum stopping means operable to stop said drum at a predetermined angular position for unclamping a photoconductor sheet from said drum for discharge of a photoconductor sheet; and a pressure plate connected over and to said back end clamp member extending across said recess and over said front end clamp member when said front and back end clamp members clamp the leading and trailing portions of a photoconductor sheet in said recess, to cover and close said recess.

17. A photoconductor sheet clamp apparatus comprising, in combination, a drum adapted to have a photoconductor sheet wound therearound, and having a recess, at one part of its peripheral surface, extending along a generating line of said peripheral surface; a drum shaft about which said drum is rotatable; a front end clamp member in said recess and operable to clamp the leading end portion of a photoconductor sheet into said recess; front end clamp member operation means operable on said front end clamp member to clamp and unclamp the leading end portion of a photoconductor sheet; a back end clamp member operable to clamp the trailing end portion of a photoconductor sheet in said recess, said back end clamp member being disengagable from said recess and rotatable around the axis of said drum shaft independently of said drum; back end clamp member operation means operable to move said back end clamp member relative to said drum; leading end separation guide means operable to separate the leading end portion of a photoconductor sheet from said drum for discharge of a photoconductor sheet; and drum stopping means operable to stop said drum at a predetermined angular position for unclamping a photoconductor sheet from said drum for discharge of a photoconductor sheet; said back end clamp member operating means comprising a pair of sliding plates connected to said back end clamp member each mounted on opposite sides of said drum shaft; guide means guiding said sliding plate for movement on opposite sides of said drum shaft radially of said drum; a pin extending from each of said sliding plates and into said recess when said back end clamp member is operable to clamp the trailing end portion of a photoconductor in said recess, said pin abutting said recess and movable along said recess and the outer peripheral surface of said drum; spring means biasing said sliding plate radially inwardly of said drum; a stopper member mounted adjacent the outer periphery of said drum having a concave portion facing said drum into which said pin is engageable when said pin abuts against the outer periphery of said drum for stopping the rotation of said back end clamp member with respect to the rotation of said drum; a limiting lever pivotally mounted adjacent said drum; a solenoid connected to said limiting lever for pivoting said limiting lever; said limiting lever engageable with said back end clamp member for stopping the rotation thereof when said solenoid is activated for causing said pin to ride up said recess and across the outer periphery of said drum and be engaged in said concave portion of said stopper member.

* * * * *